US008801477B2

(12) United States Patent
Kuriyagawa et al.

(10) Patent No.: US 8,801,477 B2
(45) Date of Patent: Aug. 12, 2014

(54) OUTBOARD MOTOR CONTROL APPARATUS

(75) Inventors: Koji Kuriyagawa, Saitama (JP); Keiichi Nakayama, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 197 days.

(21) Appl. No.: 13/563,886

(22) Filed: Aug. 1, 2012

(65) Prior Publication Data

US 2013/0035009 A1 Feb. 7, 2013

(30) Foreign Application Priority Data

Aug. 4, 2011 (JP) ..... 2011-171297
Aug. 4, 2011 (JP) ..... 2011-171298
Aug. 4, 2011 (JP) ..... 2011-171299

(51) Int. Cl.
*B63H 21/22* (2006.01)

(52) U.S. Cl.
USPC ..... 440/1; 440/86; 701/21

(58) Field of Classification Search
USPC ..... 440/1, 86; 701/21
See application file for complete search history.

(56) References Cited

U.S. PATENT DOCUMENTS 8,066,539 B2 * 11/2011 Suzuki et al. ..... 440/86
8,388,390 B2 * 3/2013 Kuriyagawa et al. ..... 440/1
8,444,446 B2 * 5/2013 Kuriyagawa et al. ..... 440/1
8,515,604 B2 * 8/2013 Kuriyagawa et al. ..... 701/21
8,690,621 B2 * 4/2014 Kuriyagawa et al. ..... 440/86
2011/0143610 A1 * 6/2011 Kuriyagawa et al. ..... 440/86
2011/0143612 A1 * 6/2011 Kuriyagawa et al. ..... 440/86
2011/0217888 A1 * 9/2011 Kuriyagawa et al. ..... 440/86
2011/0294375 A1 * 12/2011 Kuriyagawa et al. ..... 440/1
2012/0231684 A1 * 9/2012 Kuriyagawa et al. ..... 440/86
2012/0295498 A1 * 11/2012 Kuriyagawa et al. ..... 440/1
2013/0035009 A1 * 2/2013 Kuriyagawa et al. ..... 440/1

FOREIGN PATENT DOCUMENTS

JP 2009-190671 A 8/2009

* cited by examiner

*Primary Examiner* — Lars A Olson
*Assistant Examiner* — Jovon Hayes
(74) *Attorney, Agent, or Firm* — Carrier Blackman & Associates, P.C.; Joseph P. Carrier; William D. Blackman

(57) ABSTRACT

In a control apparatus for an outboard motor having an internal combustion engine and a transmission adapted to establish speeds including first and second speeds and transmit an engine output to a propeller with an established speed, it is configured to determine whether acceleration is instructed to the engine by an operator when the second speed is established; detect an engine speed; detect a navigation acceleration indicative of a change amount of navigation speed per predetermined time; change the gear position from the second speed to the first speed when the acceleration is determined to be instructed; and change the gear position from the first speed to the second speed when the engine speed is at or above a predetermined speed and the navigation acceleration is at or below a predetermined value after the gear position is changed to the first speed.

27 Claims, 14 Drawing Sheets

OUTBOARD MOTOR CONTROL APPARATUS

BACKGROUND

1. Technical Field

Embodiments of the invention relate to an outboard motor control apparatus, particularly to an apparatus for controlling an outboard motor with a transmission.

2. Background Art

In recent years, there is proposed a technique for an outboard motor having a transmission interposed at a power transmission shaft between an internal combustion engine and a propeller to change an output of the engine in speed and transmit it to the propeller, as taught, for example, by Japanese Laid-Open Patent Application No. 2009-190671 ('671). In the reference, when a throttle lever is manipulated by the operator to accelerate the boat, the gear position (gear ratio) of the transmission is changed from the second speed to the first speed to amplify torque to be transmitted from the engine to the propeller, thereby improving the acceleration performance, and subsequently, when the engine speed is increased and has reached a predetermined engine speed, the gear position is returned from the first speed to the second speed.

SUMMARY

A hull of a boat installed with an outboard motor experiences resistance (hull resistance) from water surface during navigation and magnitude of such resistance differs depending on specification of the hull (e.g., an offshore vessel, bass boat, etc.). Consequently, in the case of a boat with relatively large resistance, even when the engine speed is increased in response to an acceleration command and reaches the maximum speed, sometimes it is still in the middle of the acceleration, i.e., the acceleration is not yet completed.

In this case, if the technique described in '671 is applied, depending on the boat, even though the acceleration is not completed, the engine speed may reach the predetermined engine speed so that the gear position is changed from the first speed to the second speed accordingly. It means that the optimal gear position suitable to the navigating condition of the boat is not necessarily selected, disadvantageously.

An object of embodiments of the invention is therefore to overcome the foregoing drawback by providing an apparatus for controlling an outboard motor having a transmission, which apparatus can improve the acceleration performance and control the shifting operation of the transmission optimally in accordance with the navigating condition of the boat, regardless of specification of the hull.

In order to achieve the object, this invention provides in the first aspect an apparatus for controlling operation of an outboard motor adapted to be mounted on a stern of a boat and having an internal combustion engine to power a propeller through a power transmission shaft; and a transmission that is installed at the power transmission shaft, is changeable in gear position to establish speeds including at least a first speed and a second speed to transmit an output of the engine to the propeller with a gear ratio determined by established one of the speeds, comprising: an acceleration instruction determiner adapted to determine whether acceleration is instructed to the engine by an operator when the second speed is established; an engine speed detector adapted to detect an engine speed of the engine; a navigation acceleration detector adapted to detect a navigation acceleration indicative of a change amount of navigation speed of the boat per predetermined time; a first-speed changer adapted to change the gear position from the second speed to the first speed by operating the transmission when the acceleration is determined to be instructed; and a second-speed changer adapted to change the gear position from the first speed to the second speed when the detected engine speed is equal to or greater than a first predetermined speed and the detected navigation acceleration is equal to or less than a first predetermined value after the gear position is changed to the first speed by the first-speed changer.

In order to achieve the object, this invention provides in the second aspect A method for controlling operation of an outboard motor mounted on a stern of a boat and having an internal combustion engine to power a propeller through a power transmission shaft; and a transmission that is installed at the power transmission shaft, is changeable in gear position to establish speeds including at least a first speed and a second speed, and transmits an output of the engine to the propeller with a gear ratio determined by established one of the speeds, comprising the steps of: determining whether acceleration is instructed to the engine by an operator when the second speed is established; detecting an engine speed of the engine; detecting a navigation acceleration indicative of a change amount of navigation speed of the boat per predetermined time; changing the gear position from the second speed to the first speed by operating the transmission when the acceleration is determined to be instructed; and changing the gear position from the first speed to the second speed when the detected engine speed is equal to or greater than a first predetermined speed and the detected navigation acceleration is equal to or less than a first predetermined value after the gear position is changed to the first speed.

BRIEF DESCRIPTION OF THE DRAWINGS

The above and other objects and advantages of embodiments of the invention will be more apparent from the following description and drawings in which.

DESCRIPTION OF EMBODIMENTS

Embodiments of an outboard motor control apparatus according to the invention will now be explained with reference to the attached drawings.

Figure 1:
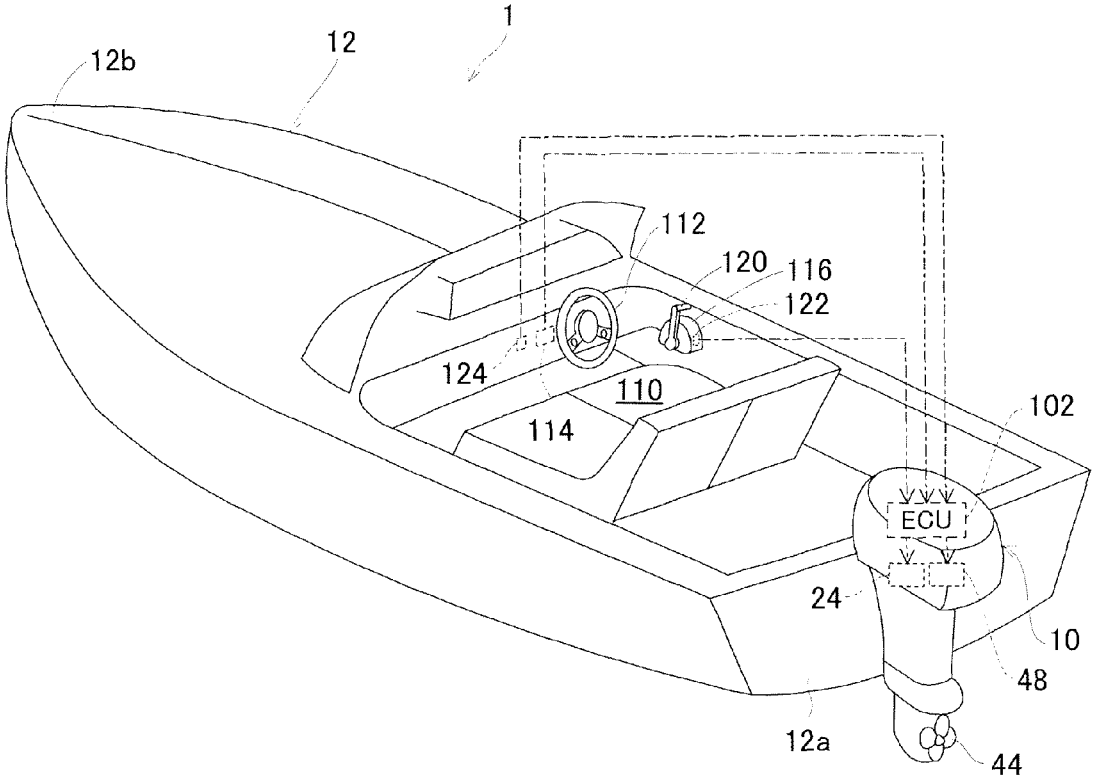
FIG. 1 is an overall schematic view of an outboard motor control apparatus including a boat (hull) according to a first embodiment of the invention.
Figure 2:
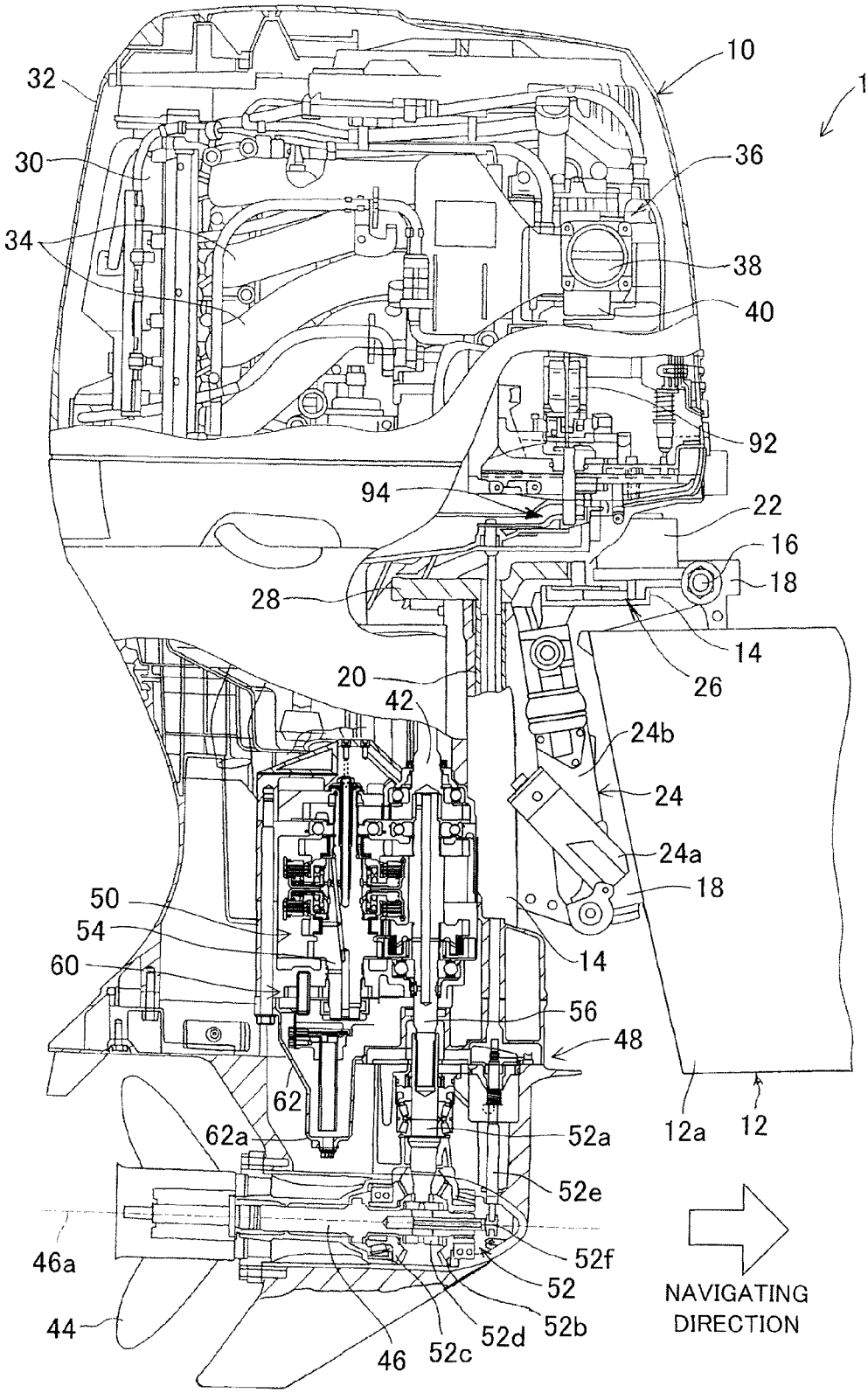
FIG. 2 is an enlarged sectional side view partially showing the outboard motor shown in FIG. 1.

FIG. 1 is an overall schematic view of an outboard motor control apparatus including a boat according to an embodiment of the invention. FIG. 2 is an enlarged sectional side view partially showing the outboard motor shown in FIG. 1 and FIG. 3 is an enlarged side view of the outboard motor.

Figure 3:
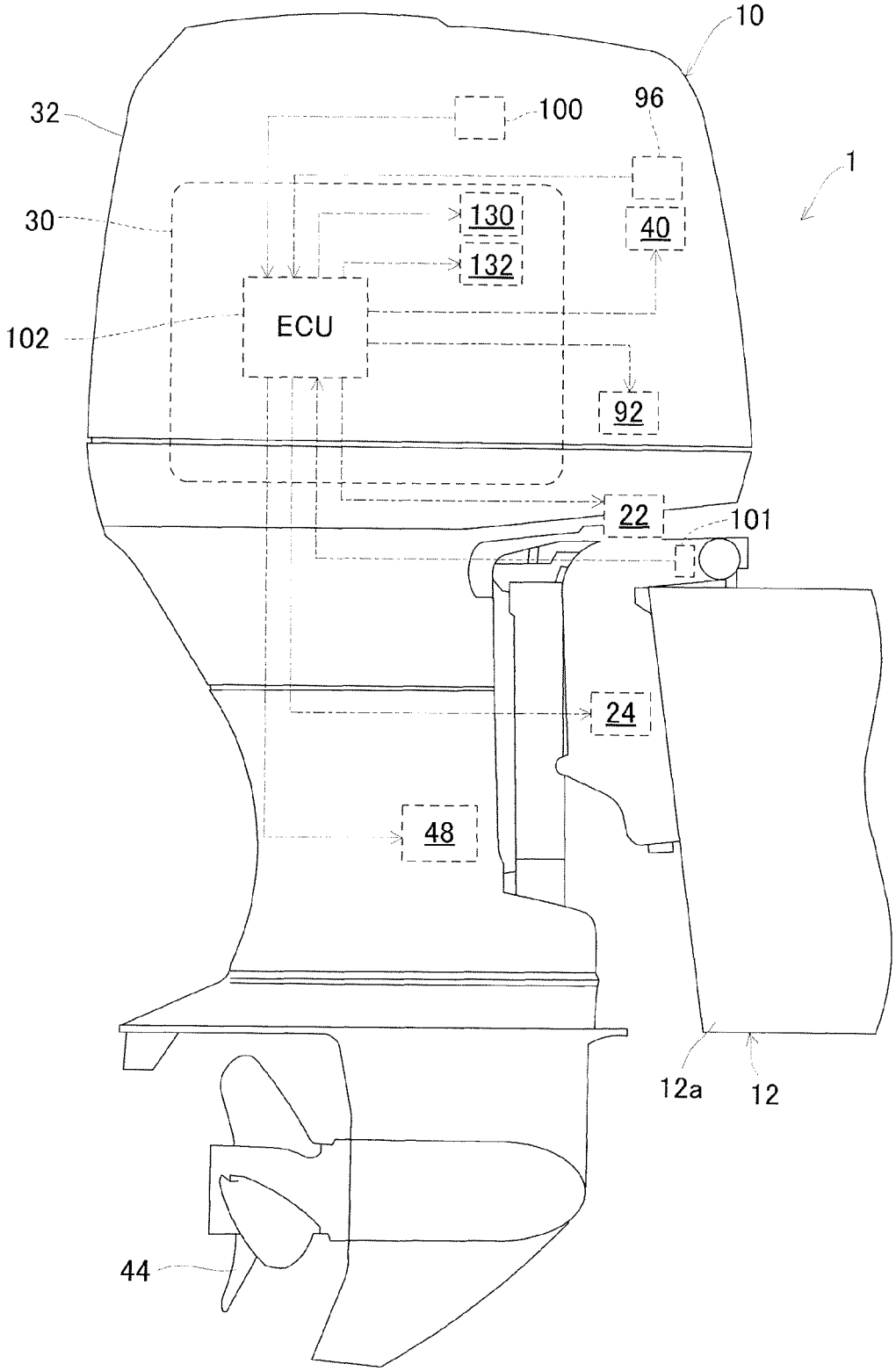
FIG. 3 is an enlarged side view of the outboard motor shown in FIG. 1.

In FIGS. 1 to 3, a symbol 1 indicates a boat or vessel whose hull 12 is mounted with an outboard motor 10. As clearly shown in FIG. 2, the outboard motor 10 is clamped (fastened) to the stern or transom 12*a* of the hull 12 through a swivel case 14, tilting shaft 16 and stern brackets 18.

An electric steering motor (actuator) 22 for operating a swivel shaft 20 which is housed in the swivel case 14 to be rotatable about the vertical axis and a power tilt-trim unit (actuator or trim angle regulating mechanism; hereinafter called the "trim unit") 24 for regulating a tilt angle and trim angle of the outboard motor 10 relative to the boat 1 (i.e., hull 12) by tilting up/down and trimming up/down are installed near the swivel case 14.

A rotational output of the steering motor 22 is transmitted to the swivel shaft 20 via a speed reduction gear mechanism 26 and mount frame 28, whereby the outboard motor 10 is steered about the swivel shaft 20 as a steering axis to the right and left directions (steered about the vertical axis).

The trim unit 24 integrally comprises a hydraulic cylinder 24*a* for adjusting the tilt angle and a hydraulic cylinder 24*b* for adjusting the trim angle. In the trim unit 24, the hydraulic cylinders 24*a*, 24*b* are extended and contracted so that the swivel case 14 is rotated about the tilting shaft 16 as a rotational axis, thereby tilting up/down and trimming up/down the outboard motor 10. The hydraulic cylinders 24*a*, 24*b* are connected to a hydraulic pressure circuit (not shown) in the outboard motor 10 and extended and contracted upon being supplied with operating oil therethrough. Since the tilt angle and trim angle both represent rotational angles of the main body of the outboard motor 10 that is rotated about the tilting shaft 16, they are simply called the "trim angle" in the following explanation.

An internal combustion engine (hereinafter referred to as the "engine") 30 is disposed in the upper portion of the outboard motor 10. The engine 30 comprises a spark-ignition, water-cooling gasoline engine with a displacement of 2,200 cc. The engine 30 is located above the water surface and covered by an engine cover 32.

An air intake pipe 34 of the engine 30 is connected to a throttle body 36. The throttle body 36 has a throttle valve 38 installed therein and an electric throttle motor (actuator) 40 is integrally disposed thereto for opening and closing the throttle valve 38.

The output shaft of the throttle motor 40 is connected to the throttle valve 38 via a speed reduction gear mechanism (not shown). The throttle motor 40 is operated to open and close the throttle valve 38, thereby regulating a flow rate of air sucked in the engine 30 to control a speed of the engine 30 (engine speed).

The outboard motor 10 further comprises a drive shaft (power transmission shaft) 42 that is supported to be rotatable about the vertical axis and connected at its upper end with the crankshaft (not shown in FIG. 2) of the engine 30, a propeller shaft (power transmission shaft) 46 that is supported to be rotatable about the horizontal axis and attached at its one end with a propeller 44, and a transmission (automatic transmission) 48 that is interposed between the drive shaft 42 and propeller shaft 46 and has a plurality of gear positions, i.e., first, second and third speeds. Thus, power of the engine 30 can be transmitted to the propeller 44 through the drive shaft 42, transmission 48 and propeller shaft 46.

In the initial condition of the trim unit 24 (in which the trim angle θ is at the initial angle (0 degree)), the propeller shaft 46 is positioned so that its axis line 46*a* is substantially parallel to the navigating direction of the boat 1.

The transmission 48 comprises a transmission mechanism 50 that is changeable in a plurality of the gear positions and a shift mechanism 52 that can change a shift position among forward, reverse and neutral positions.

Figure 4:
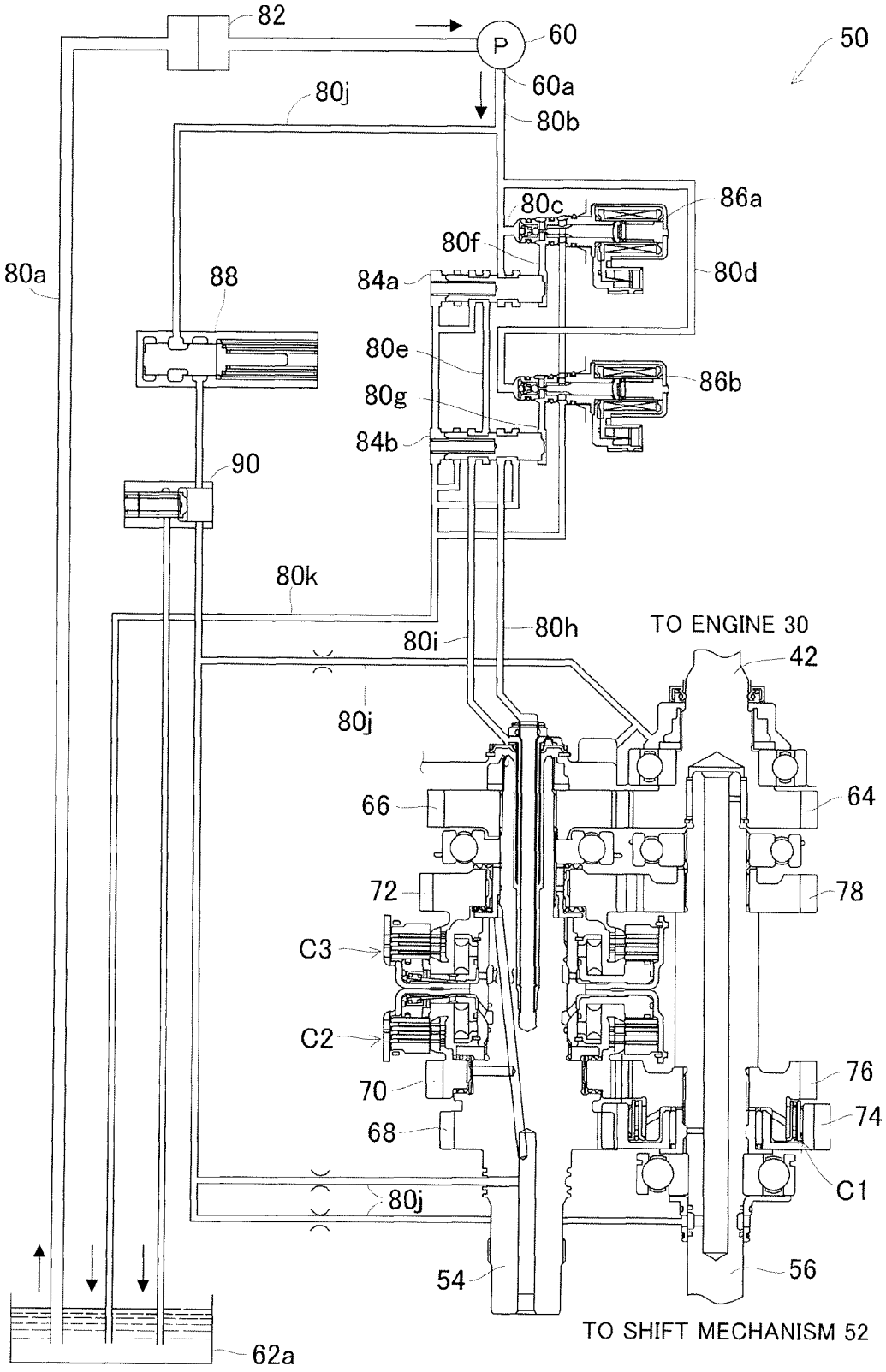
FIG. 4 is a hydraulic pressure circuit diagram schematically showing a hydraulic pressure circuit of a transmission mechanism shown in FIG. 2.

FIG. 4 is a hydraulic pressure circuit diagram schematically showing a hydraulic pressure circuit of the transmission mechanism 50.

As shown in FIGS. 2 and 4, the transmission mechanism 50 comprises a parallel-axis type transmission mechanism with distinct gear positions (ratios), which includes the drive shaft (input shaft) 42, a countershaft 54 connected to the drive shaft 42 through a transmission gear, and a first connecting shaft (output shaft) 56 connected to the countershaft 54 through several transmission gears. Those shafts 42, 54, 56 are installed in parallel.

The countershaft 54 is connected with a hydraulic pump (gear pump; shown in FIGS. 2 and 4) 60 that pumps up the operating oil (lubricating oil) and forwards it to hydraulic (transmission) clutches and lubricated portions of the transmission mechanism 50 (explained later). The foregoing shafts 42, 54, 56, hydraulic pump 60 and the like are housed in a case 62 (shown only in FIG. 2). An oil pan 62*a* for receiving the operating oil is formed at the bottom of the case 62.

In the so-configured transmission mechanism 50, the gear installed on the shaft to be rotatable relative thereto is fixed on the shaft through the transmission clutch so that one of the gear positions, i.e., first to third speeds is selected or established, and the output of the engine 30 is changed with the selected gear position (speed; gear) and transmitted to the propeller 44 through the shift mechanism 52 and propeller shaft 46. A gear ratio of the gear position (speed) is set to be the highest in the first speed and decreases as the speed changes to second and then third speed. Specifically, for instance, the first speed gear ratio is 2.3, the second speed gear ratio 1.9, and the third speed gear ratio 1.7.

The further details of the transmission mechanism 50 will be explained. As clearly shown in FIG. 4, the drive shaft 42 is supported with an input primary gear 64. The countershaft 54 is supported with a counter primary gear 66 to be meshed with the input primary gear 64, and also supported with a counter first-speed gear 68, counter second-speed gear 70 and counter third-speed gear 72.

The first connecting shaft 56 is supported with an output first-speed gear 74 to be meshed with the counter first-speed gear 68, an output second-speed gear 76 to be meshed with the counter second-speed gear 70, and an output third-speed gear 78 to be meshed with the counter third-speed gear 72.

In the above configuration, when the output first-speed gear 74 supported to be rotatable relative to the first connecting shaft 56 is brought into a connection with the first connecting shaft 56 through a first-speed clutch C1, the first speed (gear position) is established. The first-speed clutch C1 comprises a one-way clutch. When a second-speed or third-speed hydraulic clutch C2 or C3 (explained later) is supplied with hydraulic pressure so that the second or third speed is established and the rotational speed of the first connecting shaft 56 becomes greater than that of the output first-speed gear 74, the first-speed clutch C1 makes the output first-speed gear 74 rotate idly (i.e., rotate without being meshed).

When the counter second-speed gear 70 supported to be rotatable relative to the countershaft 54 is brought into a connection with the countershaft 54 through the second-speed hydraulic clutch C2, the second speed (gear position) is established. Further, when the counter third-speed gear 72 supported to be rotatable relative to the countershaft 54 is brought into a connection with the countershaft 54 through the third-speed hydraulic clutch C3, the third speed (gear position) is established. The hydraulic clutches C2, C3 connect the gears 70, 72 to the countershaft 54 upon being supplied with hydraulic pressure, while making the gears 70, 72 rotate idly when hydraulic pressure is not supplied.

Thus the interconnections between the gears and shafts through the clutches C1, C2, C3 are performed by controlling hydraulic pressure supplied from the hydraulic pump 60 to the hydraulic clutches C2, C3.

The further explanation will be made. When the hydraulic pump 60 is driven by the engine 30, it pumps up the operating oil in the oil pan 62*a* to draw it through an oil passage 80*a* and strainer 82 and forwards it from a discharge port 60*a* to a first switching valve 84*a* through an oil passage 80*b* and to first and second electromagnetic solenoid valves (linear solenoid valves) 86*a*, 86*b* through oil passages 80*c*, 80*d*.

The first switching valve 84*a* is connected to a second switching valve 84*b* through an oil passage 80*e*. Each of the valves 84*a*, 84*b* has a movable spool installed therein and the spool is urged by a spring at its one end (left end in the drawing) toward the other end. The valves 84*a*, 84*b* are connected on the sides of the other ends of the spools with the first and second solenoid valves 86*a*, 86*b* through oil passages 80*f*, 80*g*, respectively.

Upon being supplied with current (i.e., made ON), a spool housed in the first solenoid valve 86*a* is displaced to output hydraulic pressure supplied from the hydraulic pump 60 through the oil passage 80*c* to the other end side of the spool of the first switching valve 84*a*. Accordingly, the spool of the first switching valve 84*a* is displaced to its one end side, thereby forwarding the operating oil in the oil passage 80*b* to the oil passage 80*e*.

Similarly to the first solenoid valve 86*a*, upon being supplied with current (i.e., made ON), a spool of the second solenoid valve 86*b* is displaced to output hydraulic pressure supplied from the hydraulic pump 60 through the oil passage 80*d* to the other end side of the spool of the second switching valve 84*b*. Accordingly, the spool of the second switching valve 84*b* is displaced to its one end side, thereby forwarding the operating oil in the oil passage 80*e* to the second-speed hydraulic clutch C2 through the oil passage 80*h*. In contrast, when the second solenoid valve 86*b* is not supplied with current (made OFF) and no hydraulic pressure is outputted to the other end side of the second switching valve 84*b*, the operating oil in the oil passage 80*e* is forwarded to the third-speed hydraulic clutch C3 through the oil passage 80*i*.

When the first and second solenoid valves 86*a*, 86*b* are both made OFF, hydraulic pressure is not supplied to the hydraulic clutches C2, C3 and hence, the output first-speed gear 74 and first connecting shaft 56 are interconnected through the first-speed clutch C1 so that the first speed is established.

When the first and second solenoid valves 86*a*, 86*b* are both made ON, hydraulic pressure is supplied to the second-speed hydraulic clutch C2 and accordingly, the counter second-speed gear 70 and countershaft 54 are interconnected so that the second speed is established. Further, when the first solenoid valve 86*a* is made ON and the second solenoid valve 86*b* is made OFF, hydraulic pressure is supplied to the third-speed hydraulic clutch C3 and accordingly, the counter third-speed gear 72 and countershaft 54 are interconnected so that the third speed is established. Thus, one of the gear positions of the transmission 48 is selected (i.e., transmission control is conducted) by controlling ON/OFF of the first and second switching valves 84*a*, 84*b*.

Note that the operating oil (lubricating oil) from the hydraulic pump 60 is also supplied to the lubricated portions (e.g., the shafts 42, 54, 56, etc.) of the transmission 48 through the oil passage 80*b*, an oil passage 80*j*, a regulator valve 88 and a relief valve 90. Also, the first and second switching valves 84*a*, 84*b* and the first and second solenoid valves 86*a*, 86*b* are connected with an oil passage 80*k* adapted to relieve pressure.

The explanation on FIG. 2 is resumed. The shift mechanism 52 comprises a second connecting shaft 52*a* that is connected to the first connecting shaft 56 of the transmission mechanism 50 and installed parallel to the vertical axis to be rotatably supported, a forward bevel gear 52*b* and reverse bevel gear 52*c* that are connected to the second connecting shaft 52*a* to be rotated, a clutch 52*d* that can engage the propeller shaft 46 with either one of the forward bevel gear 52*b* and reverse bevel gear 52*c*, and other components.

The interior of the engine cover 32 is disposed with an electric shift motor (actuator) 92 that drives the shift mechanism 52. The output shaft of the shift motor 92 can be connected via a speed reduction gear mechanism 94 with the upper end of a shift rod 52*e* of the shift mechanism 52. When the shift motor 92 is operated, its output appropriately displaces the shift rod 52*e* and a shift slider 52*f* to move the clutch 52*d* to change the shift position among forward, reverse and neutral positions.

When the shift position is the forward or reverse position, the rotational output of the first connecting shaft 56 is transmitted via the shift mechanism 52 to the propeller shaft 46 to rotate the propeller 44 to generate thrust in one of the directions making the boat 1 move forward or backward. The outboard motor 10 is equipped with a power source (not shown) such as a battery or the like attached to the engine 30 to supply operating power to the motors 22, 40, 92, etc.

As shown in FIG. 3, a throttle opening sensor (throttle opening change amount detector) 96 is installed near the throttle valve 38 and produces an output or signal indicative of opening of the throttle valve 38, i.e., throttle opening TH. A crank angle sensor (engine speed detector) 100 is installed near the crankshaft of the engine 30 and produces a pulse signal at every predetermined crank angle. A trim angle sensor 101 is installed near the tilting shaft 16 and produces an output or signal corresponding to a trim angle θ of the outboard motor 10

The outputs of the foregoing sensors and switch are sent to an Electronic Control Unit (ECU) 102 disposed in the outboard motor 10. The ECU 102 comprises a microcomputer having a CPU, ROM, RAM and other devices and is installed in the engine cover 32 of the outboard motor 10.

As shown in FIG. 1, a steering wheel 112 is installed near a cockpit (operator's seat) 110 of the hull 12 to be manipulated by the operator (not shown). A steering angle sensor 114 attached on a shaft (not shown) of the steering wheel 112 produces an output or signal corresponding to the steering angle applied or inputted by the operator through the steering wheel 112.

A remote control box 116 provided near the cockpit 110 is equipped with a throttle lever (shift/throttle lever) 120 installed to be manipulated by the operator. The lever 120 is attached on a rotary shaft (not shown) supported to be rotatable in the remote control box 116, so that it can be moved or swung in the front-back direction from the initial position. The lever 120 is used by the operator to input a shift change command (forward/reverse/neutral change command) and an engine speed regulation command including an acceleration/deceleration command (or instruction) for the engine 30.

A lever position sensor 122 is installed in the remote control box 116 and produces an output or signal corresponding to a manipulation position (manipulation angle; hereinafter sometimes called the "manipulation amount") LVR of the lever 120 which is positioned by the operator, i.e., a rotational angle of the rotary shaft of the lever 120. The lever position sensor 120 comprises a rotational angle sensor such as a potentiometer.

Further, a GPS (Global Positioning System) receiver (receiver) 124 that receives a GPS signal is installed at an appropriate position of the hull 12. The GPS receiver 124 produces an output or signal indicative of positional information of the boat 1 acquired from the GPS signal. The outputs of the sensors 114, 122 and GPS receiver 124 are also sent to the ECU 102.

The ECU 102 is connected to the above sensors and GPS receiver 124 through, for example, a communication method standardized by the National Marine Electronics Association (NMEA), i.e., the NMEA 2000, more specifically, through a Controller Area Network (CAN).

Based on the inputted sensor outputs, etc., the ECU 102 controls the operations of the motors 22, 92 to steer the outboard motor 10 or change the shift position, performs the transmission control through the transmission 48, and performs the trim angle control through the trim unit 24 to regulate the trim angle θ. Further, based on the output of the lever position sensor 122, the ECU 102 controls the operation of the throttle motor 40 to open and close the throttle valve 38 to regulate the throttle opening TH, thereby conducting the throttle opening control.

Furthermore, based on the inputted sensor outputs, the ECU 102 determines a fuel injection amount and ignition timing of the engine 30, supplies fuel by the determined injection amount through an injector 130 (shown in FIG. 3) and ignites air-fuel mixture, which is composed of injected fuel and sucked air, through an ignition device 132 (shown in FIG. 3) at the determined ignition timing.

Thus, the outboard motor control apparatus according to the embodiments is a Drive-By-Wire (DBW) type apparatus whose operation system (steering wheel 112, lever 120) has no mechanical connection with the outboard motor 10.

Figure 5:
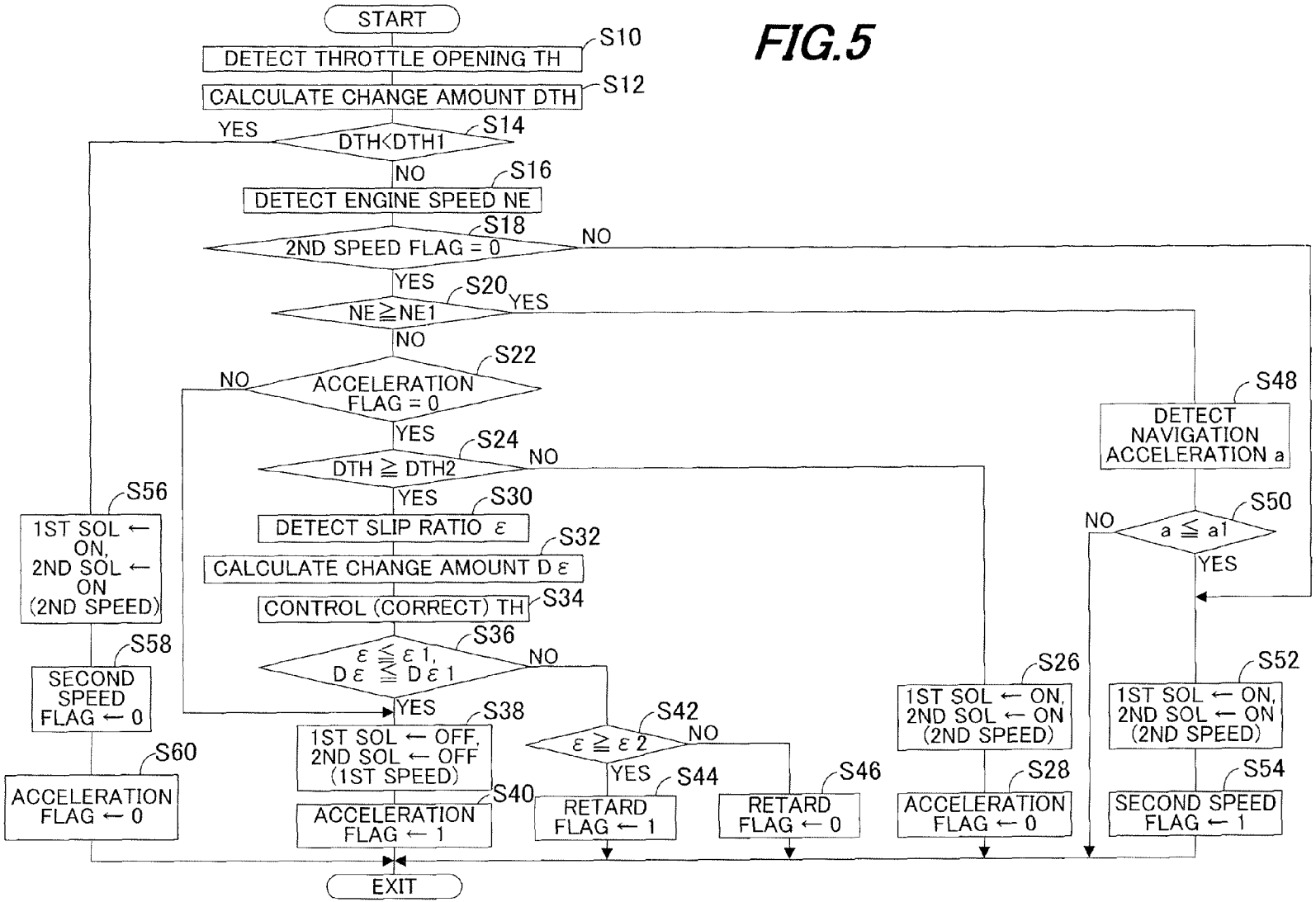
FIG. 5 is a flowchart showing transmission control operation, throttle opening control operation and ignition timing control operation by an electronic control unit shown in FIG. 1.

FIG. 5 is a flowchart showing the transmission control operation, throttle opening control operation and ignition timing control operation by the ECU 102. The illustrated program is executed by the ECU 102 at predetermined intervals, e.g., 100 milliseconds.

The program begins at S10, in which the throttle opening TH is detected or calculated from the output of the throttle opening sensor 96 and proceeds to S12, in which a change amount (variation) DTH of the detected throttle opening TH per unit time (e.g., 500 milliseconds) is detected or calculated.

The program proceeds to S14, in which it is determined whether the deceleration is instructed to the engine 30 by the operator, i.e., whether the engine 30 is in the operating condition to decelerate the boat 1. Specifically, when the change amount DTH of the throttle opening TH is less than a first prescribed value DTH1 set to a negative value (e.g., −0.5 degree), the throttle valve 38 is determined to be operated in the closing direction (i.e., the deceleration is instructed to the engine 30).

When the result in S14 is negative, the program proceeds to S16, in which the output pulses of the crank angle sensor 100 are counted to detect or calculate the engine speed NE and to S18, in which it is determined whether the bit of an after-acceleration second-speed changed flag (hereinafter called the "second speed flag") is 0. The bit of this flag is set to 1 when the gear position is changed from the first speed to the second speed after the acceleration is completed (explained later), and otherwise, reset to 0.

Since the initial value of the second speed flag is 0, the result in S18 in the first program loop is generally affirmative and the program proceeds to S20, in which it is determined whether the engine speed NE is equal to or greater than a first predetermined speed NE1. The predetermined speed NE1 will be explained later.

Since the engine speed NE is generally less than the first predetermined speed NE1 in a program loop immediately after the engine start, the result in S20 is negative and the program proceeds to S22, in which it is determined whether the bit of an acceleration determining flag (explained later; indicated as "acceleration flag" in the drawing) is 0. Since the initial value of this flag is also 0, the result in S22 in the first program loop is generally affirmative and the program proceeds to S24.

In S24, it is determined whether the acceleration (precisely, the rapid acceleration) is instructed to the engine 30 by the operator, i.e., whether the engine 30 is in the operating condition to accelerate the boat 1 (rapidly). This determination is made by checking as to whether the throttle valve 38 is rapidly operated in the opening direction.

To be more specific, the change amount DTH of the throttle opening TH detected in S12 is compared to a second prescribed value (prescribed value) DTH2 and when the change amount DTH is equal to or greater than the second prescribed value DTH2, it is determined that the throttle valve 38 is rapidly operated in the opening direction, i.e., the acceleration is instructed. The second prescribed value DTH2 is set to a value (positive value) greater than the first prescribed value DTH1, as a criterion for determining whether the acceleration is instructed, e.g., to 0.5 degree.

When the result in S24 is negative, i.e., when it is determined that the acceleration is not instructed to the engine 30, the program proceeds to S26, in which the first and second solenoid valves 86*a*, 86*b* (indicated as "1ST SOL," "2ND SOL" in the drawing) are both made ON to select (or maintain) the second speed in the transmission 48, and to S28, in which the bit of the acceleration determining flag is reset to 0.

On the other hand, when the result in S24 is affirmative, the program proceeds to S30, in which a slip ratio ϵ indicating the rotating condition of the propeller 44 is detected or calculated and to S32, in which a change amount (variation) Dϵ of the slip ratio ϵ per unit time (e.g., 500 milliseconds) is detected or calculated. The slip ratio ϵ is calculated based on theoretical velocity Va and navigation velocity (actual velocity; navigation speed) V of the boat 1, using the Equation (1) as follows:

Slip ratio $\epsilon$=(Theoretical velocity *Va* (km/h)−Navigation velocity *V* (km/h))/Theoretical velocity *Va* (km/h) Equation (1)

In the Equation (1), the navigation velocity V is calculated based on the output (positional information) of the GPS receiver 124. The theoretical velocity Va is calculated based on the operating conditions of the engine 30 and transmission 48 and specification of the propeller 44, as can be seen in the following Equation (2):

Theoretical velocity *Va* (km/h)=(Engine speed *NE* (rpm)×Propeller pitch (inch)×60×2.54×$10^{-5}$)/(Gear ratio of gear position) Equation (2)

In the Equation (2), the propeller pitch is a value indicating a theoretical distance by which the boat 1 proceeds per one rotation of the propeller 44. The gear ratio of gear position is a gear ratio of the currently-selected gear position in the transmission 48, e.g., is 1.9 in the second speed, as mentioned above. The value of 60 is used for converting the engine speed NE for one minute into that for one hour, and the value of 2.54×$10^{-5}$ is used for converting a unit of the propeller pitch from inch to kilometer.

Then the program proceeds to S34, in which the throttle opening TH of the engine 30 is controlled to suppress the increase in the slip ratio $\epsilon$ of the propeller 44. Specifically, when the acceleration is instructed to the engine 30, the propeller 44 tends to be rotated idly because it draws in air bubbles generated around the propeller 44 due to the increase in the rotational speed, and consequently the slip ratio $\epsilon$ rises so that the grip force sometimes becomes relatively small. To cope with it, in S34, the throttle opening TH is appropriately corrected to suppress the increase in the slip ratio $\epsilon$.

Figure 6:
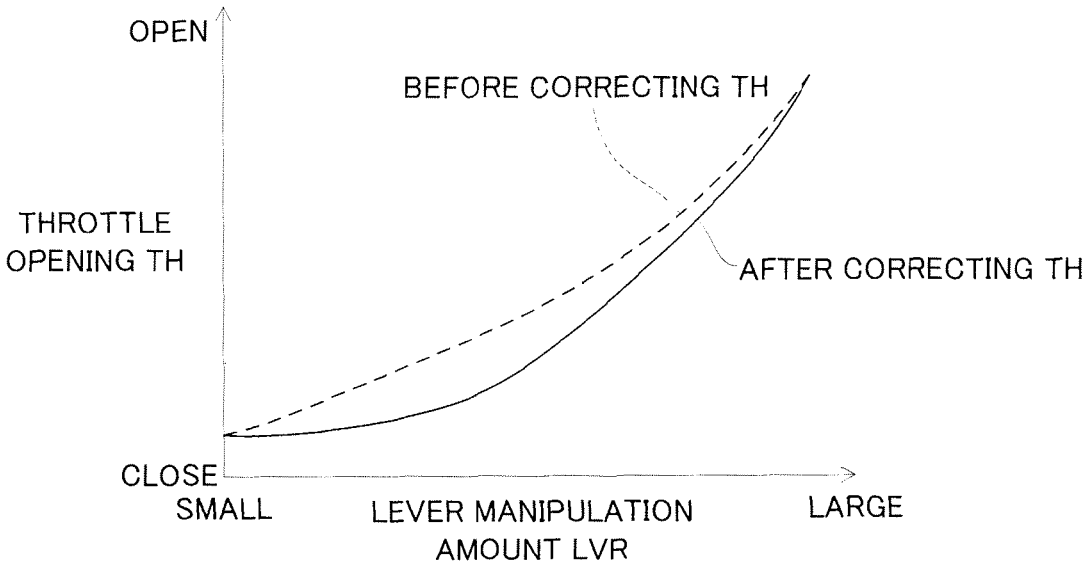
FIG. 6 is an explanatory graph showing the characteristics of a throttle opening with respect to a manipulation amount of a throttle lever, which is used in the operation of the FIG. 5 flowchart.

FIG. 6 is an explanatory graph showing the characteristics of the throttle opening TH with respect to the manipulation amount (position) LVR of the lever 120. In FIG. 6, the characteristics before correcting the throttle opening TH are indicated by a dashed line and those after correction are indicated by a solid line.

As shown, in S34, the operation of the throttle motor 40 is controlled so that a rate of change of the throttle opening TH with respect to the manipulation amount LVR of the lever 120 is decreased (the increase in the throttle opening TH is slowed). As a result, when the acceleration is instructed to the engine 30, i.e., when the manipulation amount LVR is increased, the throttle valve 38 is opened more slowly compared to before the correction is applied, thereby avoiding the sharp increase in the engine speed NE, i.e., in the rotational speed of the propeller 44. Consequently, it becomes possible to prevent the air bubbles from being generated around the propeller 44 and to suppress the increase in the slip ratio $\epsilon$. Accordingly, the rotational speed of the propeller 44 can be increased while maintaining the grip force.

Next the program proceeds to S36, in which it is determined whether the slip ratio $\epsilon$ is equal to or less than a first predetermined slip ratio $\epsilon$1 and the change amount D$\epsilon$ of the slip ratio $\epsilon$ is equal to or less than a predetermined slip ratio change amount D$\epsilon$1. The first predetermined slip ratio $\epsilon$1 is set to a relatively small value (e.g., 0.3) as a criterion for determining that, when the slip ratio $\epsilon$ is at or below this criterion value, the grip force is relatively large. The predetermined slip ratio change amount D$\epsilon$1 is set to 0 and it means that the latter determination above is made for checking as to whether the change amount D$\epsilon$ is 0 or a negative value. In other words, the process of S36 is conducted to determine whether the slip ratio $\epsilon$ of the propeller 44 is changed in the decreasing direction and whether the grip force becomes relatively large.

When the result in S36 is affirmative, the program proceeds to S38, in which the first and second solenoid valves 86*a*, 86*b* are both made OFF to change the gear position (shift down the gear) from the second speed to the first speed. As a result, the output torque of the engine 30 is amplified through the transmission 48 (more precisely, the transmission mechanism 50) which has been shifted down to the first speed, and transmitted to the propeller 44, thereby improving the acceleration performance. When the gear position is changed to the first speed in S38, the foregoing control to correct the throttle opening TH is finished and the normal control, i.e., the control of the throttle opening TH based on the characteristics indicated by the dashed line in FIG. 6 is resumed.

Next the program proceeds to S40, in which the bit of the acceleration determining flag is set to 1. Specifically, the bit of this flag is set to 1 when the acceleration is determined to be instructed to the engine 30 and the gear position is changed from the second speed to the first speed, and otherwise, reset to 0. Upon setting the bit of the acceleration determining flag to 1, the result in S22 in the next and subsequent loops becomes negative and the program skips S24 to S36.

Thus, the transmission 48 is set in the second speed during a period from when the engine 30 is started until the acceleration is instructed and the slip ratio $\epsilon$ meets the aforementioned conditions (i.e., during the normal operation). With this, it becomes possible to ensure the usability of the outboard motor 10 similarly to that of an outboard motor having no transmission.

When the result in S36 is negative, the program proceeds to S42, in which it is determined whether the slip ratio $\epsilon$ is equal to or greater than a second predetermined slip ratio $\epsilon$2 set greater than the first predetermined slip ratio $\epsilon$1. The second predetermined slip ratio $\epsilon$2 is set as a criterion for determining that, when the slip ratio $\epsilon$ is at or above this criterion value, the grip force of the propeller 44 is relatively small, e.g., set to 0.5. Specifically, the process of S42 is conducted to determine whether the slip ratio $\epsilon$ is increased and the grip force of the propeller 44 is decreased despite the fact that the throttle opening TH is corrected in S34.

When the result in S42 is affirmative, the program proceeds to S44, in which the bit of an ignition timing retard flag (initial value 0; indicated as "retard flag" in the drawing) is set to 1. When the bit of this flag is set to 1, in another program which is not shown, retard control for retarding the ignition timing of the engine 30 is conducted, in other words, the ignition timing calculated based on the engine speed NE, etc., is retarded by a preset angle (e.g., 5 degrees) to decrease the output of the engine 30.

In response to the decrease in the engine output, the grip force of the propeller 44 is increased instantaneously and the slip ratio $\epsilon$ is decreased to a value below the second predetermined slip ratio $\epsilon$2. Accordingly, the result in S42 becomes negative and the program proceeds to S46, in which the bit of the ignition timing retard flag is reset to 0 to stop the foregoing retard control and conduct the normal ignition timing control.

It should be noted that, in S44, the engine output may be decreased through the fuel injection amount of the engine 30 instead of the ignition timing. Specifically, the engine output may be decreased through control to reduce the amount of fuel to be supplied to the engine 30, i.e., by reducing the fuel injection amount calculated based on the engine speed NE, etc., by a predetermined amount. In this case, in S46, the control to reduce the fuel injection amount is stopped or not conducted and the normal fuel injection control is conducted.

After the transmission 48 is changed to the first speed in S38, when the engine speed NE is gradually increased and the acceleration through the torque amplification in the first speed is nearly completed (i.e., the acceleration range is nearly saturated), the engine speed NE reaches the first predetermined speed NE1. Subsequently, in the next program loop, the result in S20 becomes affirmative and the program proceeds to S48 onward. Thus the first predetermined speed NE1 is set to a relatively high value (e.g., 5000 rpm) as a criterion for determining whether the acceleration in the first speed is nearly completed.

In S48, based on the output of the GPS receiver 124, a navigation acceleration a ($m/s^2$) indicative of a change amount of the navigation velocity V per predetermined time (unit time), i.e., a change rate of the navigation velocity V with respect to time, is detected. Specifically, the navigation velocity V is detected based on the output of the GPS receiver 124 and the detected navigation velocity V is differentiated (dV/dt) to obtain the navigation acceleration a.

Next, the program proceeds to S50, in which it is determined whether the acceleration through the torque amplification in the first speed is completed. Specifically, the navigation acceleration a detected in S48 is compared to a first predetermined value a1 and when the navigation acceleration a is equal to or less than the first predetermined value a1, the acceleration is determined to be completed. The first predetermined value a1 is set as a criterion for determining whether the acceleration is completed, e.g., set to 5 $m/s^2$.

When the result in S50 is negative, the program is terminated with the first speed being maintained, while when the result is affirmative, the program proceeds to S52, in which the first and second solenoid valves 86*a*, 86*b* are both made ON to change the gear position (shift up the gear) from the first speed to the second speed and to S54, in which the bit of the second speed flag is set to 1. Consequently the rotational speeds of the first and second connecting shafts 56, 52*a* and the propeller shaft 46 are increased, thereby enhancing the acceleration performance, and the navigation velocity V reaches the maximum speed (in a range of the engine performance) accordingly, i.e., the speed performance can be also enhanced.

Upon setting the bit of the second speed flag to 1 in S54, the result in S18 in the next and subsequent loops becomes negative and the program proceeds to S52 and S54 described above. Further, when the result in S14 is affirmative, the program proceeds to S56, in which the first and second solenoid valves 86*a*, 86*b* are both made ON to select the second speed in the transmission 48 and to S58 and S60, in which the bits of the second speed flag and acceleration determining flag are both reset to 0.

Figure 7:
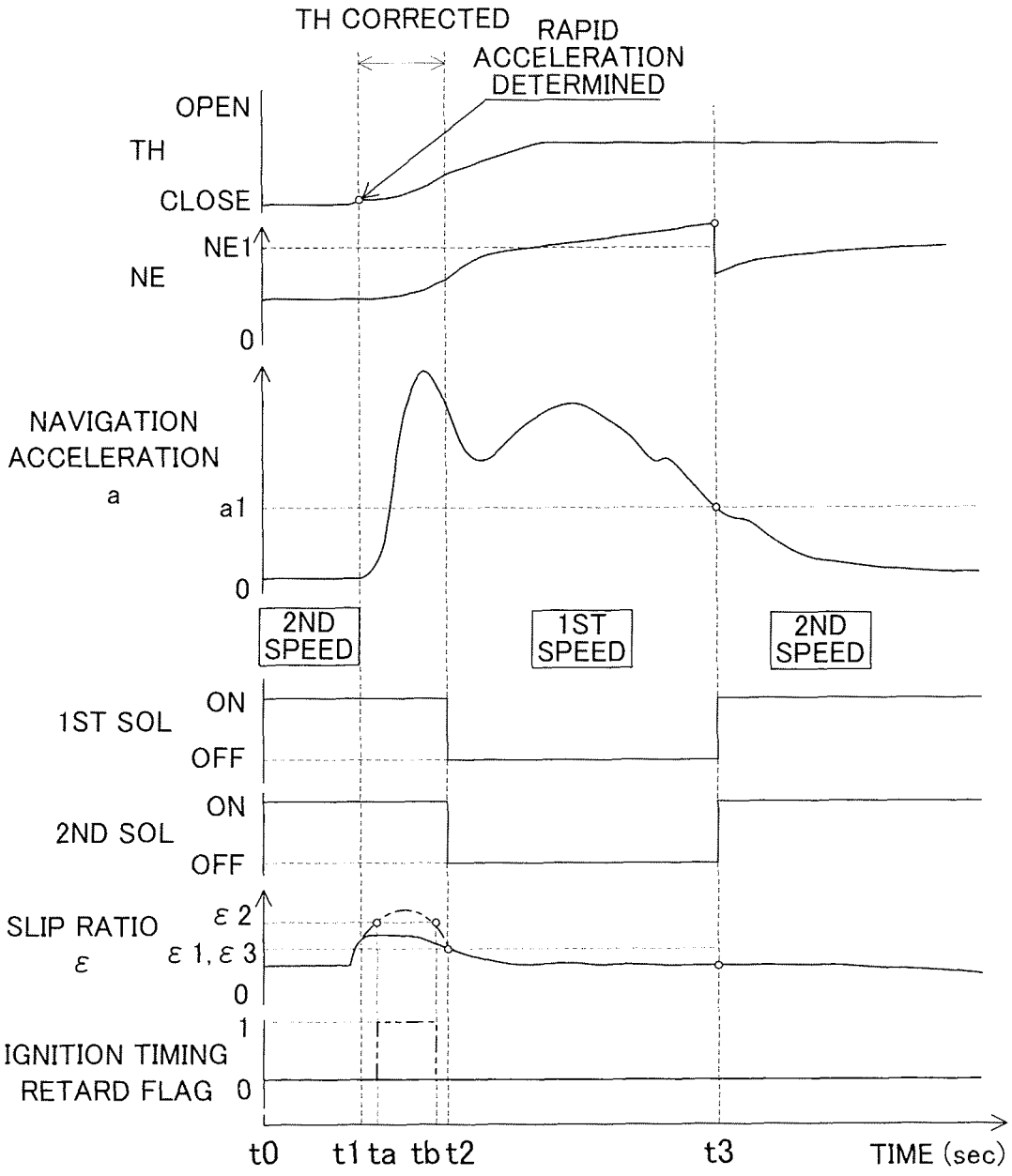
FIG. 7 is a time chart for explaining a part of the operation of the FIG. 5 flowchart.

FIG. 7 is a time chart for explaining a part of the above operation.

As shown in FIG. 7, in the normal operation from the time t0 to t1, the transmission 48 is set in the second speed (S26). After that, when the throttle valve 38 is operated in the opening direction through the manipulation of the throttle lever 120 by the operator and, at the time t1, the change amount DTH of the throttle opening is equal to or greater than the second prescribed value DTH2, it is determined that the acceleration is instructed to the engine 30 (S24). Since, immediately after the acceleration is started, the propeller 44 draws in air bubbles generated therearound and the slip ratio ϵ is increased accordingly, at the time t1, the control to correct the throttle opening TH of the engine 30 is started to suppress the increase in the slip ratio ϵ (S34).

After that, the slip ratio ϵ is gradually decreased. When, at the time t2, the slip ratio ϵ is at or below the first predetermined slip ratio ϵ1 and the change amount Dϵ is at or below the predetermined slip ratio change amount Dϵ1, the transmission 48 is changed from the second speed to the first speed (S36, S38). At that time, the control to correct the throttle opening TH is finished.

The engine speed NE is gradually increased and when, at the time t3, it is determined that the engine speed NE is at or above the first predetermined speed NE1 and also the navigation acceleration a is at or below the first predetermined value a1, the gear position is changed from the first speed to the second speed (S20, S50, S52).

As indicated by imaginary lines in a period between the time t1 and t2, in the case where the slip ratio ϵ is determined to be equal to or greater than the second predetermined slip ratio ϵ2 at the time to despite the fact that the throttle opening TH is controlled to suppress the increase in the slip ratio ϵ, the bit of the ignition timing retard flag is set to 1 to decrease the engine output (S42. S44).

In response to the decrease in the engine output, the grip force is increased, i.e., the slip ratio ϵ is decreased. When the slip ratio ϵ is determined to be below the second predetermined slip ratio ϵ2 at the time tb, the bit of the ignition timing retard flag is reset to 0 to stop decreasing the engine output (S42, S46).

As set out in the foregoing, the first embodiment is configured to determine whether acceleration is instructed to the engine 30 when the second speed is established; detect the engine speed NE; detect the navigation acceleration a indicative of the change amount of the navigation velocity (navigation speed) V per the predetermined time; change the gear position from the second speed to the first speed when the acceleration is determined to be instructed; and change the gear position from the first speed to the second speed when the engine speed NE is equal to or greater than the first predetermined speed NE1 and the navigation acceleration is equal to or less than the first predetermined value a1 after the gear position is changed to the first speed by the first-speed changer.

With this, it becomes possible to improve the acceleration performance and conduct the transmission control of the transmission 48 optimally in accordance with the navigating condition of the boat 1, regardless of specification of the hull 12. To be specific, since it is configured to change the gear position from the second speed to the first speed when it is determined that the acceleration is instructed to the engine 30 by the operator, the output torque of the engine 30 is amplified through the transmission 48 and transmitted to the propeller 44, thereby improving the acceleration performance of immediately after the acceleration is started.

Further, after the gear position is changed to the first speed, when the engine speed NE is at or above the first predetermined speed NE1 and the navigation acceleration a is at or below the first predetermined value a1, the gear position is changed from the first speed to the second speed. As a result, regardless of specification of the hull 12, i.e., regardless of magnitude of resistance acting from water surface to the hull 12, the completion of acceleration can be accurately detected and, since the gear position is changed to the second speed at that time, the transmission control of the transmission 48 can be performed optimally in accordance with the navigating (accelerating) condition of the boat 1. Due to the optimal transmission control in accordance with the navigating condition of the boat 1, it becomes possible to reduce the fuel consumption of the engine 30, i.e., enhance the fuel efficiency.

Further, it is configured to detect the navigation acceleration a based on the output of the GPS receiver 124. With this, it becomes possible to accurately detect the navigation acceleration a with the simple structure.

Further, it is configured to detect the navigation acceleration a by detecting the navigation velocity V based on the output of the GPS receiver 124 and differentiating the navigation velocity V. With this, it becomes possible to detect the navigation acceleration a more accurately.

Further, it is configured to detect the change amount DTH of the throttle opening TH and determine that the acceleration is instructed when the change amount DTH is equal to or greater than the second prescribed value (prescribed value) DTH2. With this, it becomes possible to accurately determine whether the acceleration is instructed.

Next, an outboard motor control apparatus according to a second embodiment of this invention will now be explained.

The second embodiment will be explained with focus on the points of difference from the first embodiment.

Figure 8:
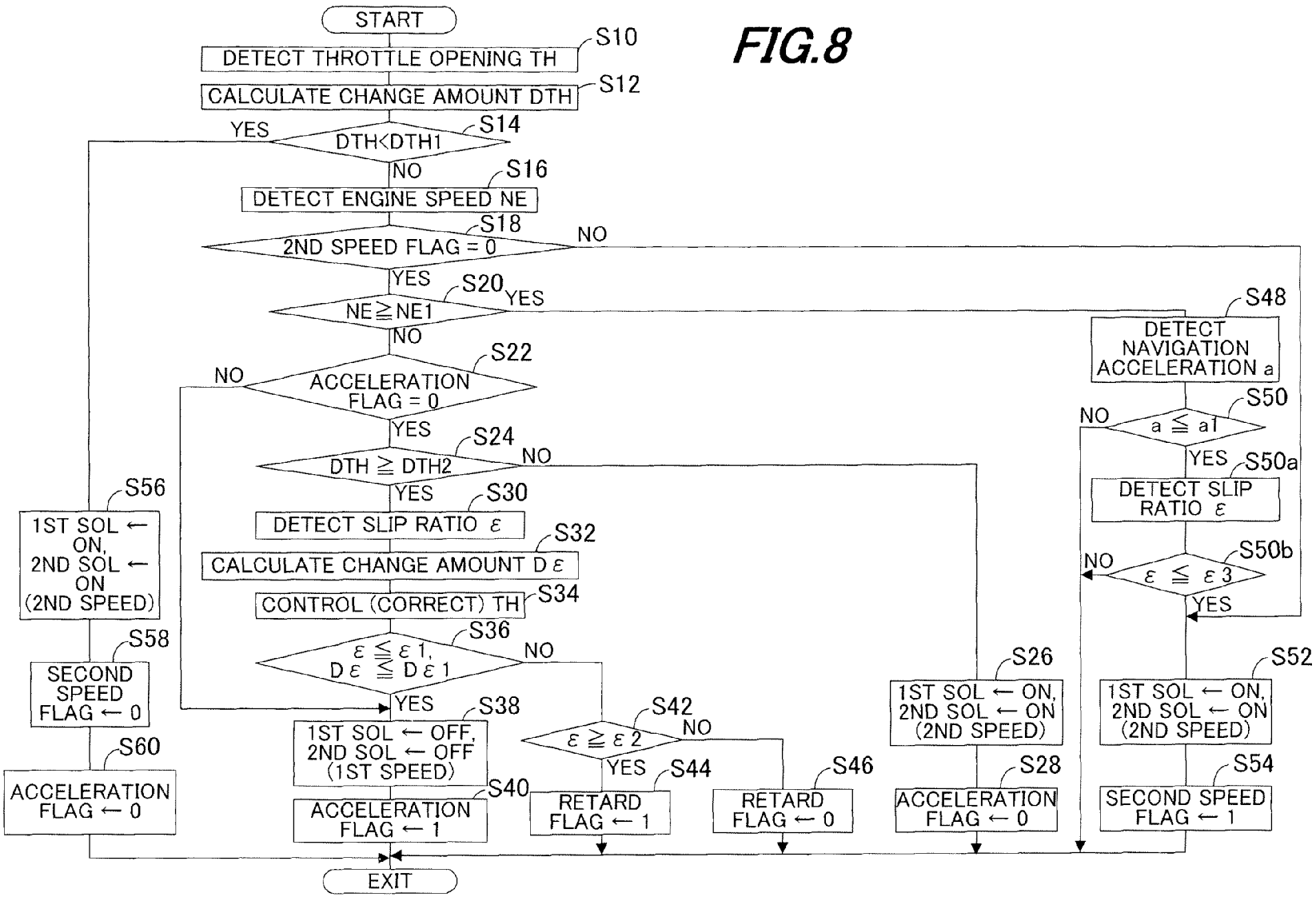
FIG. 8 is a flowchart similarly to FIG. 5, but showing transmission control operation, throttle opening control operation and ignition timing control operation by an electronic control unit of an outboard motor control apparatus according to a second embodiment of the invention.

FIG. 8 is a flowchart similarly to FIG. 5, but showing transmission control operation, throttle opening control operation and ignition timing control operation by the ECU 102 according to the second embodiment. Note that the same steps as in the FIG. 5 flowchart are given with the same step numbers.

The processes of S10 to S50 are conducted similarly to the FIG. 5 flowchart.

When the result in S50 is negative, the program is terminated with the first speed being maintained, while when the result is affirmative, the program proceeds to S50*a*, in which the slip ratio ϵ of the propeller 44 is detected or calculated through the Equations (1) and (2) mentioned in S30.

Next the program proceeds to S50*b*, in which it is determined whether the slip ratio ϵ detected in S50*a* is equal to or less than a third predetermined slip ratio (predetermined slip ratio) 83. The third predetermined slip ratio ϵ3 is set to a relatively small value (e.g., 0.3) as a criterion for determining that, when the slip ratio ϵ is at or below this criterion value, the grip force is relatively large. Thus, the process of S50*b* is made for determining whether the grip force of the propeller 44 is relatively large.

When the result in S50*b* is negative, the remaining steps are skipped with the first speed being maintained, while when the result is affirmative, the program proceeds to S52, and up to S60, the processes are conducted similarly to the FIG. 5 flowchart.

A part of the operation in the FIG. 8 flowchart will be explained with reference to the FIG. 7 time chart.

The explanation on the time t0 to t2 is omitted, as it is the same as in the first embodiment.

The engine speed NE is gradually increased and when, at the time t3, it is determined that the engine speed NE is at or above the first predetermined speed NE1, the navigation acceleration a is at or below the first predetermined value a1, and also the slip ratio ϵ is at or below the third predetermined slip ratio ϵ3, the gear position is changed from the first speed to the second speed (S20, S50, S50*b*, S52).

As mentioned in the foregoing, in the second embodiment, it is configured to detect the slip ratio ϵ of the propeller 44 based on the theoretical velocity Va of the boat 1 and the navigation velocity V; and change the gear position from the first speed to the second speed when the engine speed NE is equal to or greater than the first predetermined speed NE1, the navigation acceleration a is equal to or less than the first predetermined value a1 and the slip ratio ϵ is equal to or less than the third predetermined slip ratio (predetermined slip ratio) ϵ3 after the gear position is changed to the first speed.

With this, the use of the engine speed NE and navigation acceleration a makes possible to accurately detect the completion of acceleration, while the use of the slip ratio ϵ makes possible to, for example, detect that the slip ratio ϵ is decreased and becomes a relatively small value (i.e., the grip force is increased), so that the gear position can be changed to the second speed at the time when the above two are detected. Consequently, it becomes possible to avoid the delay in acceleration that should arise in the case where the gear position is changed to the second speed when the slip ratio of the propeller 44 is relatively high (i.e., the grip force is small), thereby further enhancing the acceleration performance, and the optimal transmission control of the transmission 48 can be performed in accordance with the navigating (accelerating) condition of the boat 1.

The remaining configuration as well as the effects is the same as that in the first embodiment.

Next, an outboard motor control apparatus according to a third embodiment of this invention will now be explained.

In an outboard motor configured as described in '671, when the gear position is changed from the first speed to the second speed after the acceleration is completed, since torque is not amplified through the transmission, the torque to be transmitted to the propeller is decreased and it may give the operator a deceleration feel.

To cope with it, one possible approach is to, before the gear position is changed to the second speed, regulate the trim angle by starting the trim-up operation to increase the boat speed, thereby mitigating the deceleration feel. However, if the timing to start the trim-up operation is determined only based on, for instance, the engine speed, i.e., if the trim-up operation is started at the time when the engine speed reaches a predefined speed, since magnitude of resistance acting on the hull during navigation differs depending on specification of the hull as mentioned above, this timing is sometimes not appropriate and it may rather cause pitching (vibration or shake in the vertical direction) of the boat, disadvantageously. Therefore, the third embodiment is configured to prevent such disadvantageous condition.

Figure 9:
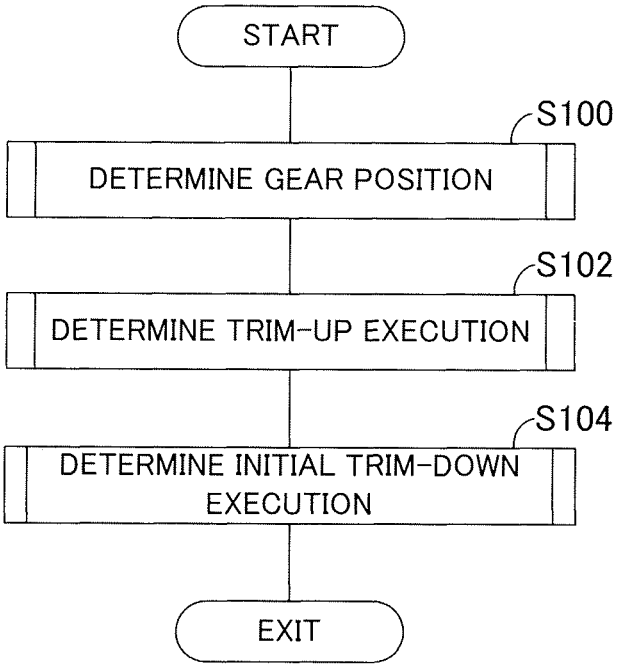
FIG. 9 is a flowchart showing transmission control operation, trim angle control operation, throttle opening control operation and ignition timing control operation by an electronic control unit of an outboard motor control apparatus according to a third embodiment of the invention.

FIG. 9 is a flowchart showing transmission control operation, trim angle control operation, throttle opening control operation and ignition timing control operation by the ECU 102 according to the third embodiment. The illustrated program is executed by the ECU 102 at predetermined intervals, e.g., 100 milliseconds.

The program begins at S100, in which a gear position determining process for determining which gear position of the first to third speeds should be selected in the transmission 48, is conducted.

Figure 10:
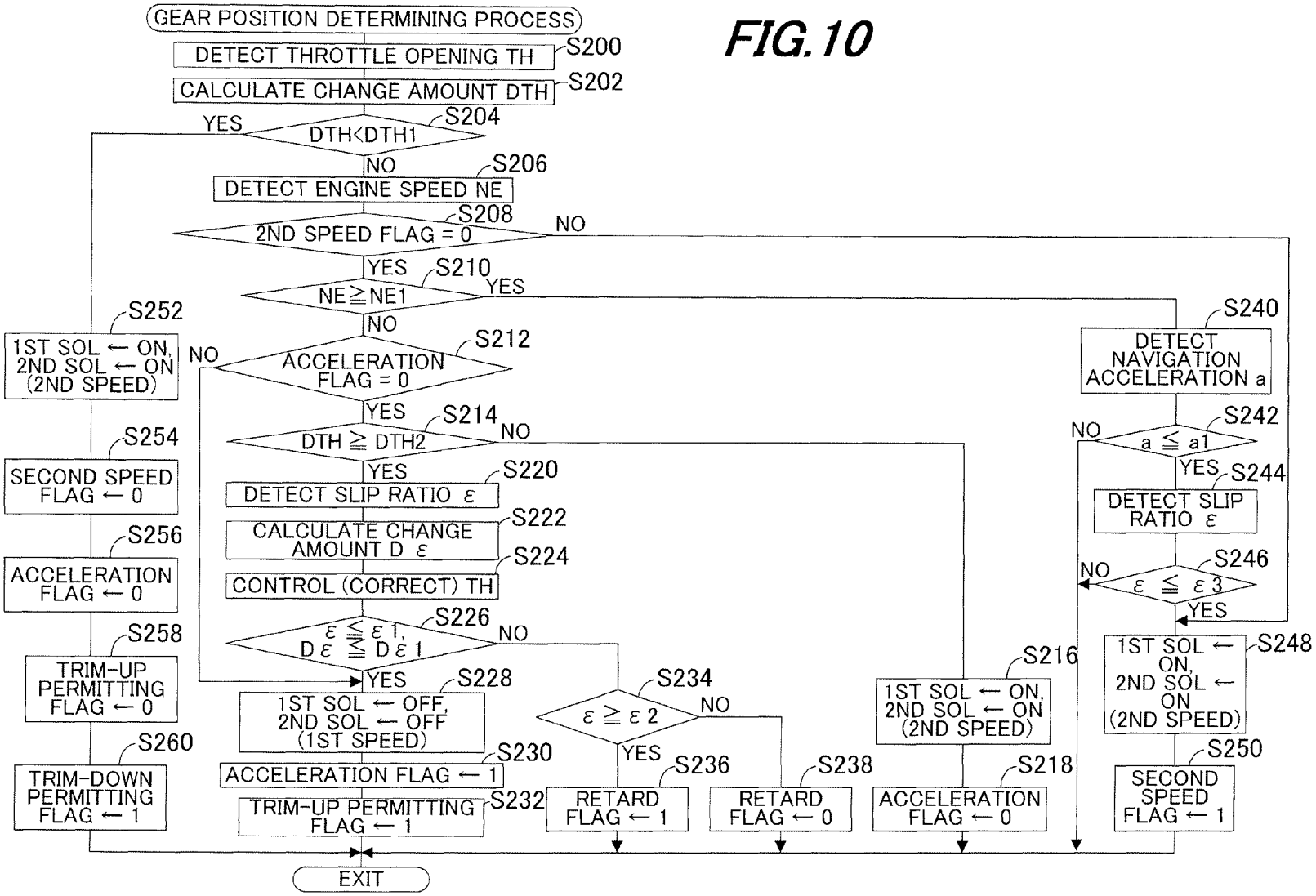
FIG. 10 is a subroutine flowchart showing a gear position determining process of the FIG. 9 flowchart.

FIG. 10 is a subroutine flowchart showing the gear position determining process.

The processes of S200 to S230 are conducted similarly to S10 to S40 of the FIG. 5 flowchart in the first embodiment.

Following the step of S230, the program proceeds to S232, in which the bit of a trim-up permitting flag (initial value 0) is set to 1, whereafter the program is terminated. Specifically, the bit of this flag being set to 1 means that the change amount DTH of the throttle opening TH is equal to or greater than the second prescribed value DTH2 and the transmission 48 is changed to the first speed, in other words, the trim-up operation to be conducted based on the engine speed NE and navigation acceleration a is permitted (explained later), while that being reset to 0 means that the trim-up operation is not needed, i.e., for example, the deceleration is instructed to the engine 30.

When the result in S226 is negative, the program proceeds to S234, and up to S256, the processes are conducted similarly to the processes of S42 to S60 of the FIG. 5 flowchart. Note that the processes of S244 and S246 are the same as those of S50*a* and S50*b* of the FIG. 8 flowchart in the second embodiment.

Next the program proceeds to S258, in which the bit of the trim-up permitting flag is reset to 0 and to S260, in which the bit of a trim-down permitting flag (initial value: 0) is set to 1. Specifically, the bit of this flag being set to 1 means that the change amount DTH of the throttle opening TH is less than the first prescribed value DTH1 and the trim-down operation (explained later) is permitted, while that being reset to 0 means that the trim-down operation is not needed.

Returning to the explanation on the FIG. 9 flowchart, the program proceeds to S102, in which a trim-up execution determining process for determining whether the trim-up operation of the outboard motor 10 should be executed, is conducted.

Figure 11:
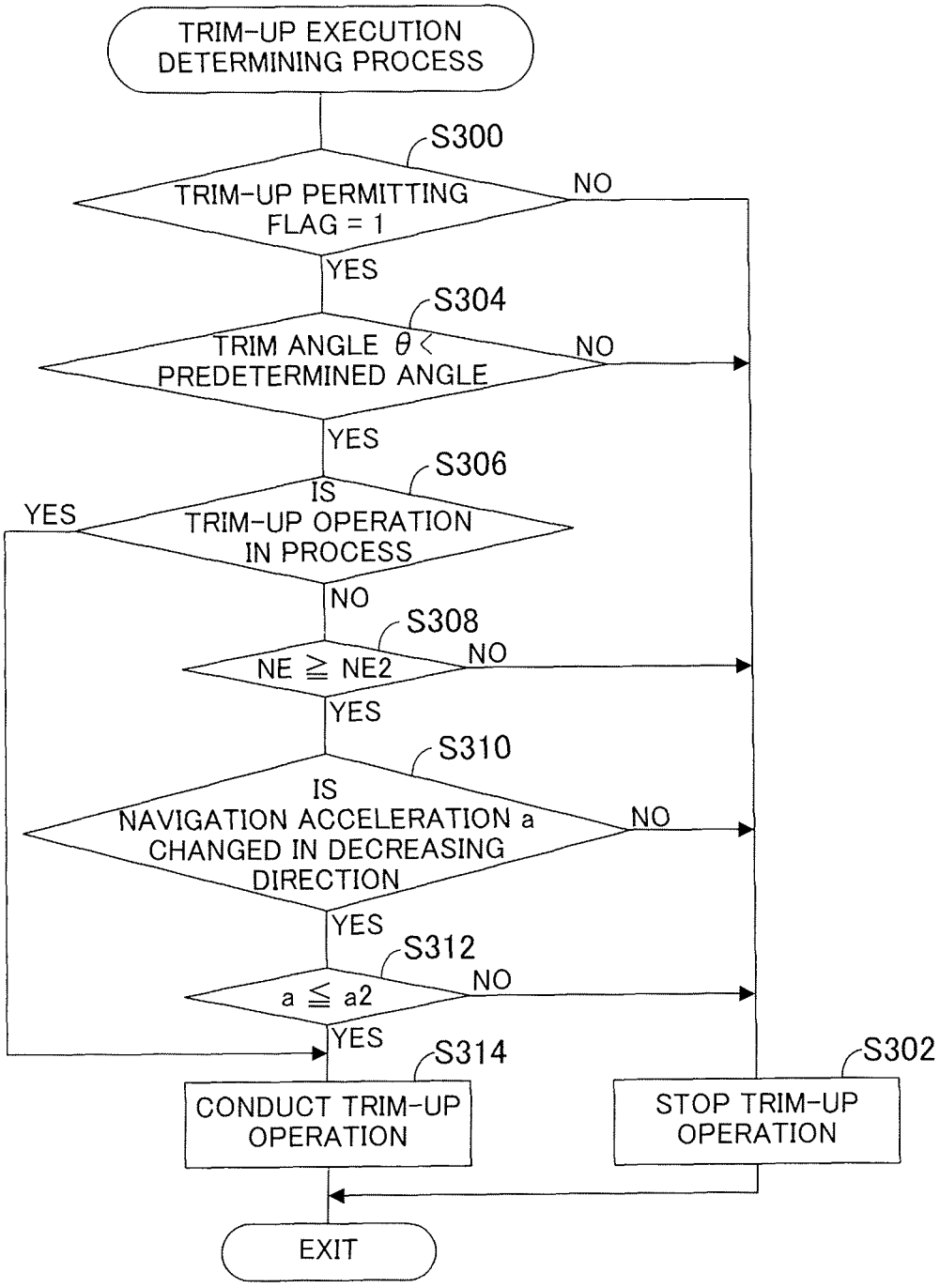
FIG. 11 is a subroutine flowchart showing a trim-up execution determining process of the FIG. 9 flowchart.

FIG. 11 is a subroutine flowchart showing the trim-up execution determining process.

As illustrated, in S300, it is determined whether the bit of the trim-up permitting flag is 1. When the result in S300 is negative, since it means that the trim-up operation is not necessary, the program proceeds to S302, in which the trim-up operation is stopped or not conducted.

On the other hand, when the result in S300 is affirmative, i.e., when the change amount DTH of the throttle opening TH is equal to or greater than the second prescribed value DTH2 and the gear position of the transmission 48 is being changed to the first speed, the program proceeds to S304, in which it is determined whether the trim angle θ is less than a predetermined angle (e.g., 10 degrees).

When S304 is first processed, the trim angle θ is at the initial angle (0 degree), so that the result is generally affirmative and the program proceeds to S306. In S306, it is determined whether the trim-up operation of the outboard motor 10 through the trim unit 24 is in process. When the program first proceeds to S306, the result in S306 is generally negative and the program proceeds to S308, in which it is determined whether the engine speed NE is equal to or greater than a second predetermined speed NE2. Similarly to the first predetermined speed, the second predetermined speed NE2 is set to a relatively high value (e.g., 5000 rpm) as a criterion for determining whether the acceleration in the first speed is nearly completed.

When the result in S308 is affirmative, the program proceeds to S310 and then S312, in which it is determined whether the acceleration through the torque amplification in the first speed is completed based on the navigation acceleration a. Specifically, in S310, it is determined whether the navigation acceleration a detected during navigation is changed in the decreasing direction. More exactly, slope of the navigation acceleration a detected during navigation (i.e., a change amount of the navigation acceleration a with respect to time) is obtained and it is determined whether the slope is a negative value.

When the result in S310 is affirmative, the program proceeds to S312, in which the navigation acceleration a is compared to a second predetermined value a2 and when the navigation acceleration a is equal to or less than the second predetermined value a2, the acceleration is determined to be nearly completed. The second predetermined value a2 is set greater than the first predetermined value a1, as a criterion for determining whether the acceleration is nearly completed, e.g., set to 10 $m/s^2$.

Thus, the processes of S308 to S312 are conducted to determine whether the acceleration through the torque amplification in the first speed is nearly completed based on the engine speed NE, navigation acceleration a and slope thereof.

When the result in one of S308, S310 and S312 is negative, since it is not the appropriate timing to start the trim-up operation, the program proceeds to S302, whereafter the program is terminated without conducting the trim-up operation. When the result in S312 is affirmative, the program proceeds to S314, in which the trim unit 24 is operated to conduct or start the trim-up operation. Thus, since the trim-up operation is started when the acceleration is nearly completed and before the gear position is returned from the first speed to the second speed, the boat speed is increased.

When the trim-up operation is started in S314, the result in S306 in the next and subsequent loops becomes affirmative and the program skips S308 to S312. After the trim-up operation is started, when the trim angle θ reaches the predetermined angle, the result in S304 becomes negative and the program proceeds to S302 to stop the trim-up operation.

Returning to the explanation on the FIG. 9 flowchart, the program proceeds to S104, in which an initial trim-down execution determining process for determining whether the trim-down operation of the outboard motor 10 should be executed to initialize the trim angle θ, is conducted.

Figure 12:
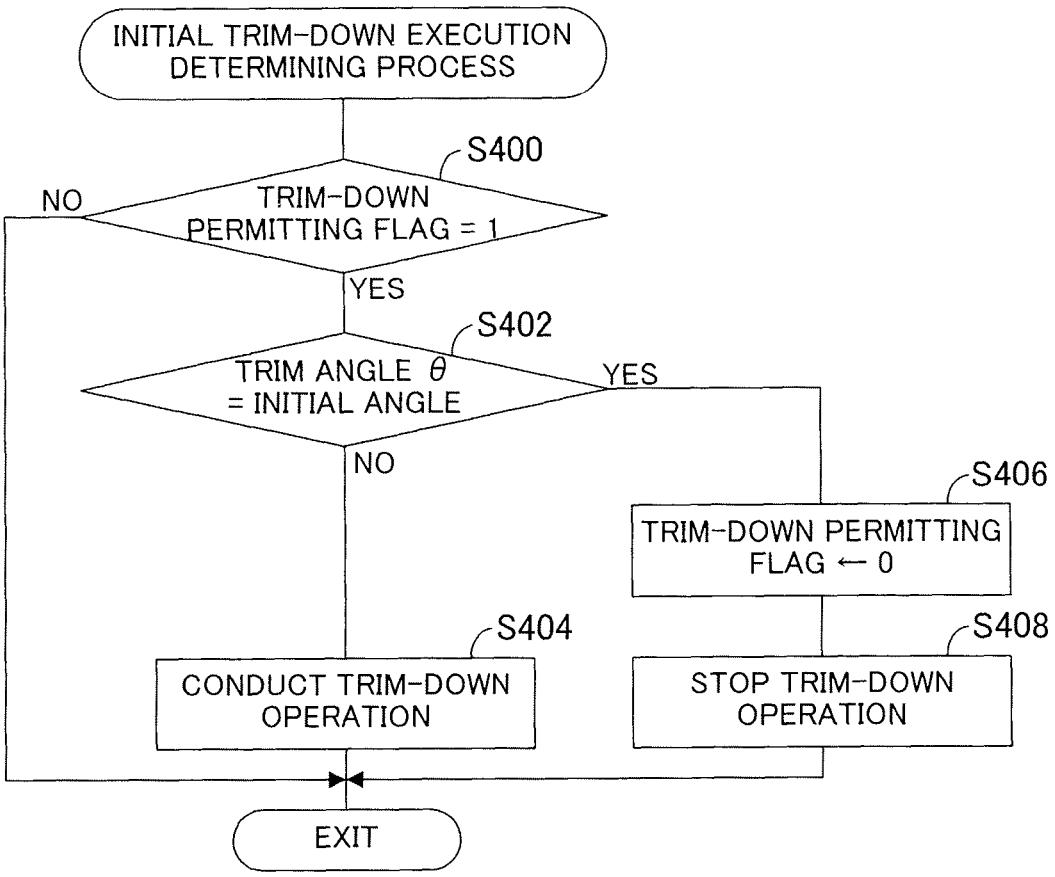
FIG. 12 is a subroutine flowchart showing an initial trim-down execution determining process of the FIG. 9 flowchart.

FIG. 12 is a subroutine flowchart showing the initial trim-down execution determining process.

As illustrated, in S400, it is determined whether the bit of the trim-down permitting flag is 1. When the result in S400 is negative, the remaining steps are skipped, while when the result is affirmative, i.e., when the change amount DTH of the throttle opening TH is less than the first prescribed value DTH1, the program proceeds to S402, in which it is determined whether the trim angle θ is at the initial angle (0 degree).

When the result in S402 is negative, the program proceeds to S404, in which the trim unit 24 is operated to start the trim-down operation. Once the trim angle θ has become (returned to) the initial angle, the result in S402 is affirmative and the program proceeds to S406, in which the bit of the trim-down permitting flag is reset to 0 and to S408, in which the trim-down operation is stopped and the program is terminated.

Figure 13:
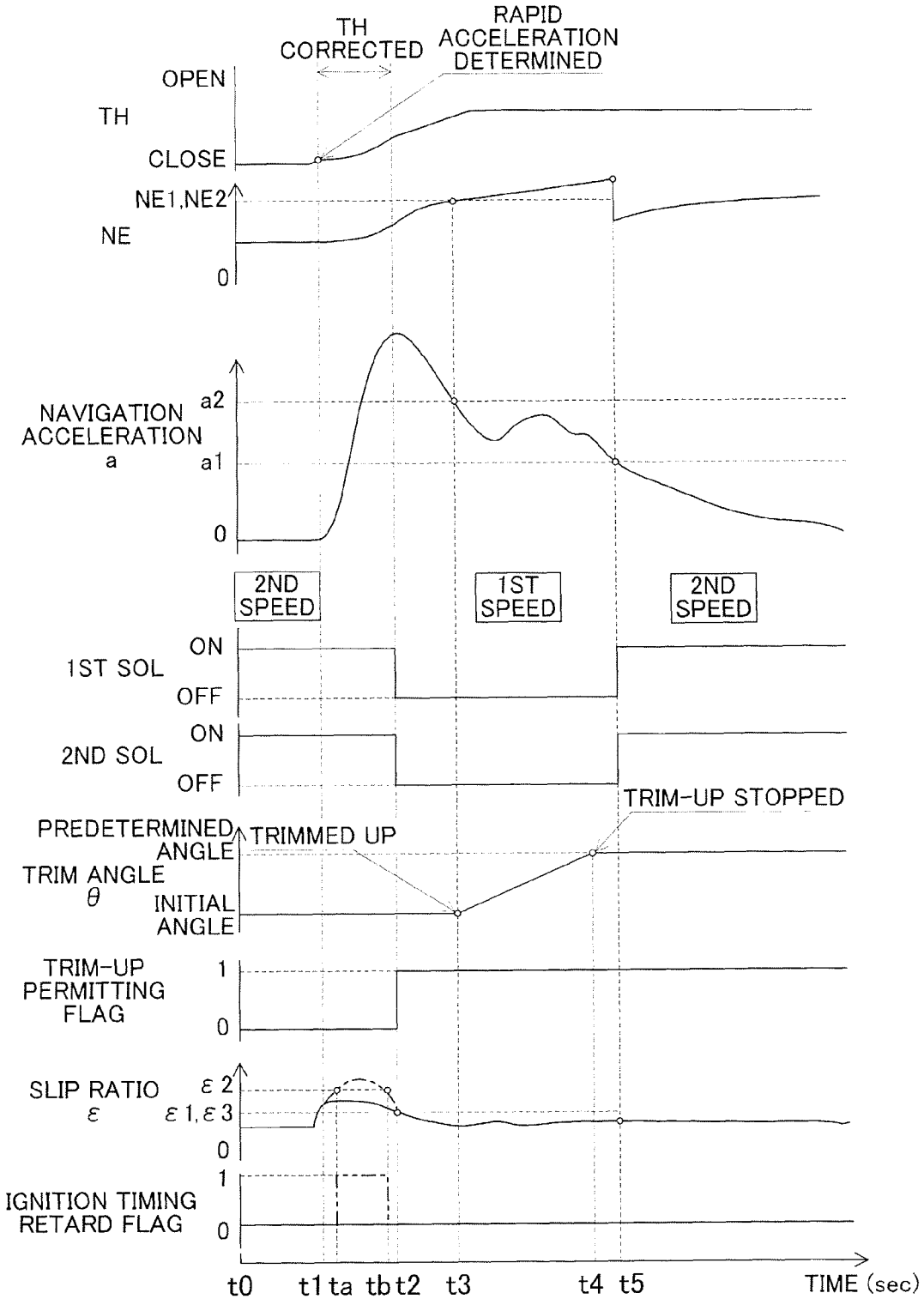
FIG. 13 is a time chart for explaining a part of the operations of the flowcharts in FIGS. 9 to 11.
Figure 14A:
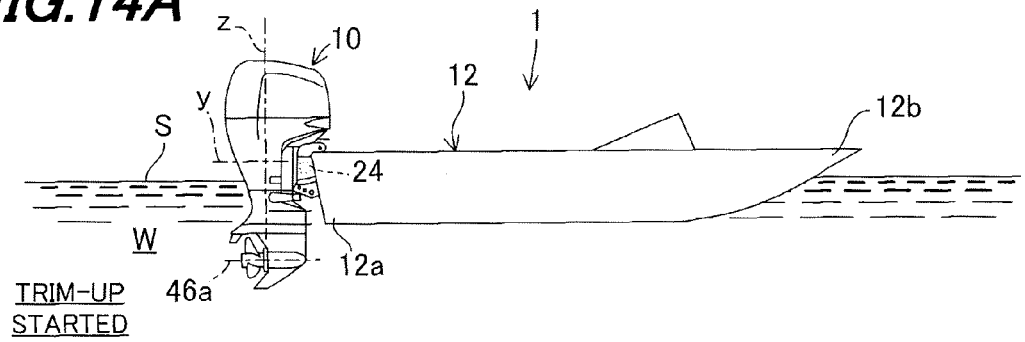
FIG. 14 is a set of explanatory views for explaining the operations of the flowcharts in FIGS. 9 to 11.
Figure 14B:
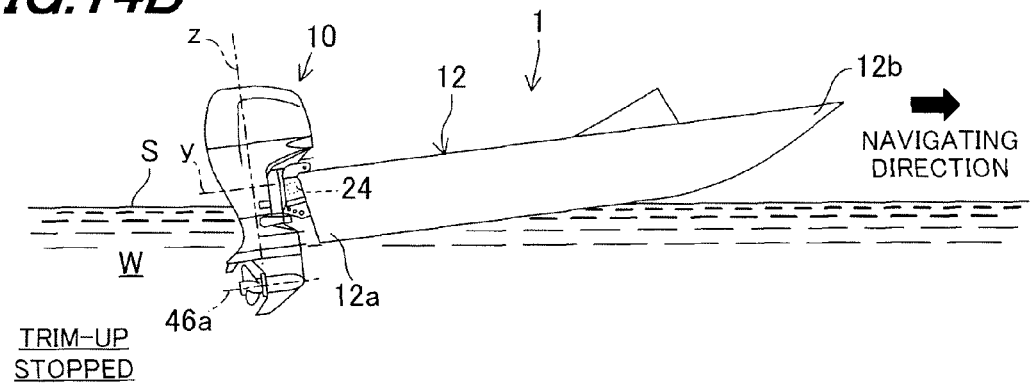
Figure 14C:
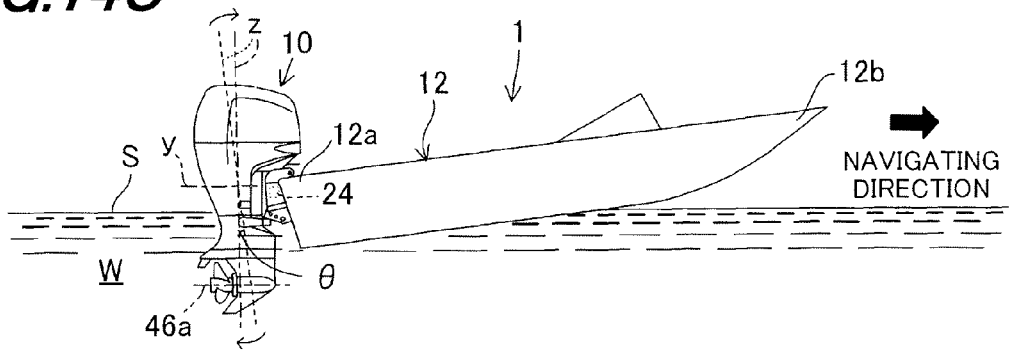

FIG. 13 is a time chart for explaining a part of the foregoing operation and FIGS. 14A to 14C are explanatory views thereof. In FIG. 14, a symbol y indicates the front-back direction of the outboard motor 10, a symbol z the vertical direction thereof, a symbol W seawater or freshwater, and a symbol S the water surface. The front-back direction y and vertical direction z represent those with respect to the outboard motor 10 and they may differ from the gravitational direction and horizontal direction depending on the tilt angle or trim angle of the outboard motor 10.

In FIG. 13, the explanation on the time t0 to t2 is omitted, as it is the same as in the first embodiment. At the time t2, the bit of the trim-up permitting flag is set to 1 (S232) and the control for correcting the throttle opening TH is finished.

As shown in FIG. 14A, during the time t0 to t1, the hull 12 and outboard motor 10 are both in the horizontal position and the trim angle θ is at the initial angle (0 degree). When the acceleration is instructed at the time t1 and the gear position is changed to the first speed at the time t2 so that the navigation velocity V is increased, as shown in FIG. 14B, the bow 12*b* of the hull 12 is lifted up and the stern 12*a* thereof is sunk down (the boat speed lies the so-called "hump" region). As can be seen from the drawing, the axis line 46*a* of the propeller shaft 46 is not parallel with the navigating direction of the boat 1.

In the case where the acceleration is continued so that the engine speed NE is gradually increased, when, at the time t3, it is determined that the engine speed NE is at or above the second predetermined speed NE2, the navigation acceleration a is at or below the second predetermined value a2 and the navigation acceleration a is changed in the decreasing direction, the trim unit 24 is operated to start the trim-up operation (S308 to S314). Then, when the trim angle θ reaches the predetermined angle (time t4), the trim-up operation is stopped (S302, S304).

The condition where the trim-up operation is stopped is shown in FIG. 14C. As can be seen in the figure, since the outboard motor 10 is trimmed up to adjust the trim angle θ, the axis line 46*a* of the propeller shaft 46 (i.e., the direction of thrust of the outboard motor 10) can be positioned substantially parallel with the navigating direction of the boat 1, resulting in the decrease of resistance against the hull 12 from the water surface S and the increase of thrust of the hull 12, thereby increasing the boat speed.

Note that, during time t3 to t4, the engine speed NE is controlled to be before over-rev, e.g., 6200 rpm.

After that, at the time t5, when it is determined that the engine speed NE is at or above the first predetermined speed NE1, the navigation acceleration a is at or below the first predetermined value a1 and the slip ratio ϵ is at or below the third predetermined slip ratio ϵ3, the gear position is changed from the first speed to the second speed (S210, S242, S246, S248).

As mentioned in the foregoing, in the third embodiment, it is configured to regulate or adjust the trim angle θ of the outboard motor 10 relative to the boat 1 through the trim-up/down operation; and start the trim-up operation when the engine speed NE is equal to or greater than the second predetermined speed NE2 and the navigation acceleration a is equal to or less than the second predetermined value a2 after the gear position is changed to the first speed.

With this, it becomes possible to start the trim-up operation at the appropriate timing (i.e., when the acceleration through the torque amplification in the first speed is nearly completed) in accordance with the navigating condition of the boat 1, regardless of specification of the hull 12. Consequently, even when the gear position is changed from the first speed to the second speed immediately after the acceleration is completed so that torque to be transmitted to the propeller 44 is decreased, since the boat speed can be increased due to the trim-up operation, it becomes possible to avoid giving a deceleration feel to the operator, i.e., mitigate a deceleration feel. Further, since the trim-up operation can be started at the appropriate timing, pitching caused by the trim-up operation can be prevented.

Further, it is configured to determine whether the navigation acceleration a detected during navigation is changed in the decreasing direction; and start the trim-up operation when the engine speed NE is equal to or greater than the second predetermined speed NE2, the navigation acceleration a is equal to or less than the second predetermined value a2 and the navigation acceleration a is determined to be changed in the decreasing direction after the gear position is changed to the first speed. With this, the trim-up operation can be started at the appropriate timing more reliably.

Further, it is configured to stop the trim-up operation when the trim angle θ reaches the predetermined angle after the trim-up operation is started. With this, it becomes possible to prevent excessive trim-up operation. Further, since the trim-up operation can be stopped at the appropriate timing, a trouble such as pitching caused by the trim-up operation can be prevented more effectively.

The remaining configuration as well as the effects is the same as those in the foregoing embodiments.

As stated above, in the first to third embodiments, it is configured to have an apparatus and method for controlling operation of an outboard motor (10) mounted on a stern (12*a*) of a boat (1; hull 12) and having an internal combustion engine (30) to power a propeller (44) through a power transmission shaft (drive shaft 42, propeller shaft 46); and a transmission (48) that is installed at the power transmission shaft, is changeable in gear position to establish speeds including at least a first speed and a second speed, and transmits an output of the engine to the propeller with a gear ratio determined by established one of the speeds, comprising: an acceleration instruction determiner (ECU 102, S24, S100, S214) adapted to determine whether acceleration is instructed to the engine by an operator when the second speed is established; an engine speed detector (crank angle sensor 100, ECU 102, S16, S100, S240) adapted to detect an engine speed (NE) of the engine; a navigation acceleration detector (ECU 102, S48, S100, S240) adapted to detect a navigation acceleration (a) indicative of a change amount of navigation velocity (V) per predetermined time; a first-speed changer (ECU 102, S24, S38, S100, S214, S228) adapted to change the gear position from the second speed to the first speed by operating the transmission when the acceleration is determined to be instructed; and a second-speed changer (ECU 102, S20, S50, S52) adapted to change the gear position from the first speed to the second speed when the detected engine speed is equal to or greater than a first predetermined speed (NE1) and the detected navigation acceleration is equal to or less than a first predetermined value (a1) after the gear position is changed to the first speed by the first-speed changer.

The apparatus and method includes: a receiver (GPS receiver 124) adapted to receive a GPS signal, and the navigation acceleration detector detects the navigation acceleration based on an output of the receiver (S48, S100, S240).

In the apparatus and method, the navigation acceleration detector detects the navigation acceleration by detecting the navigation velocity based on the output of the receiver and differentiating the detected navigation velocity (S48, S100, S240).

The apparatus and method includes: a throttle opening change amount detector (throttle opening sensor 96, ECU 102, S12, S100, S202) adapted to detect a change amount (DTH) of throttle opening (TH) of the engine, and the acceleration instruction determiner determines that the acceleration is instructed when the detected throttle opening change amount is equal to or greater than a prescribed value (second prescribed value DTH2) (S24, S100, S214).

In the second embodiment, the apparatus and method includes: a slip ratio detector (ECU 102, S50*a*) adapted to detect a slip ratio (ϵ) of the propeller based on theoretical velocity (Va) of the boat and the navigation velocity (V), and the second-speed changer changes the gear position from the first speed to the second speed when the detected engine speed is equal to or greater than the first predetermined speed, the detected navigation acceleration is equal to or less than the first predetermined value and the detected slip ratio is equal to or less than a predetermined slip ratio (third predetermined slip ratio ϵ3) after the gear position is changed to the first speed by the first-speed changer (ECU 102, S20, S50, S50*b*, S52).

In the third embodiment, the apparatus and method includes: a trim angle regulating mechanism (power tilt-trim unit 24) adapted to regulate a trim angle θ of the outboard motor relative to the boat through trim-up/down operation; and a trim-up starter (ECU 102, S102, S308, S312, S314) adapted to start the trim-up operation by operating the trim angle regulating mechanism when the detected engine speed is equal to or greater than a second predetermined speed (NE2) and the detected navigation acceleration is equal to or less than a second predetermined value (a2) after the gear position is changed to the first speed by the first-speed changer.

The apparatus and method includes: a navigation acceleration decreasing change determiner (ECU 102, S102, S310) adapted to determine whether the navigation acceleration detected during navigation is changed in a decreasing direction, and the trim-up starter starts the trim-up operation by operating the trim angle regulating mechanism when the detected engine speed is equal to or greater than the second predetermined speed, the detected navigation acceleration is equal to or less than the second predetermined value and the navigation acceleration is determined to be changed in the decreasing direction after the gear position is changed to the first speed by the first-speed changer (ECU 102, S102, S308 to S314).

The apparatus and method includes: a trim-up stopper (ECU 102, S102, S302, S304) adapted to stop the trim-up operation when the trim angle reaches a predetermined angle after the trim-up operation is started by the trim-up starter.

It should be noted that, although the outboard motor is exemplified above, this invention can be applied to an inboard/outboard motor equipped with a transmission. Further, although, in S44, the engine output is decreased by retarding the ignition timing or reducing the fuel injection amount, it may be decreased through the both operations, or through ignition-cut, fuel-cut, or the like.

It should also be noted that, although the first and second predetermined values a1, a2, first and second predetermined speed NE1, NE2, first and second prescribed values DTH1, DTH2, first to third predetermined slip ratios $\epsilon$1, $\epsilon$2, $\epsilon$3, predetermined slip ratio change amount D$\epsilon$1, displacement of the engine 30 and other values are indicated with specific values in the foregoing, they are only examples and not limited thereto.

Japanese Patent Application Nos. 2011-171297, 2011-171298 and 2011-171299, all filed on Aug. 4, 2011, are incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling operation of an outboard motor adapted to be mounted on a stern of a boat and having an internal combustion engine to power a propeller through a power transmission shaft; and a transmission that is installed at the power transmission shaft, is changeable in gear position to establish speeds including at least a first speed and a second speed to transmit an output of the engine to the propeller with a gear ratio determined by established one of the speeds, comprising:

an acceleration instruction determiner adapted to determine whether acceleration is instructed to the engine by an operator when the second speed is established;

an engine speed detector adapted to detect an engine speed of the engine;

a navigation acceleration detector adapted to detect a navigation acceleration indicative of a change amount of navigation speed of the boat per predetermined time;

a first-speed changer adapted to change the gear position from the second speed to the first speed by operating the transmission when the acceleration is determined to be instructed; and a second-speed changer adapted to change the gear position from the first speed to the second speed when the detected engine speed is equal to or greater than a first predetermined speed and the detected navigation acceleration is equal to or less than a first predetermined value after the gear position is changed to the first speed by the first-speed changer.

2. The apparatus according to claim 1, further including:

a receiver adapted to receive a GPS signal, and the navigation acceleration detector detects the navigation acceleration based on an output of the receiver.

3. The apparatus according to claim 2, wherein the navigation acceleration detector detects the navigation acceleration by detecting the navigation speed based on the output of the receiver and differentiating the detected navigation speed.

4. The apparatus according to claim 1, further including:

a throttle opening change amount detector adapted to detect a change amount of throttle opening of the engine, and the acceleration instruction determiner determines that the acceleration is instructed when the detected throttle opening change amount is equal to or greater than a prescribed value.

5. The apparatus according to claim 1, further including:

a slip ratio detector adapted to detect a slip ratio of the propeller based on theoretical velocity of the boat and the navigation speed, and the second-speed changer changes the gear position from the first speed to the second speed when the detected engine speed is equal to or greater than the first predetermined speed, the detected navigation acceleration is equal to or less than the first predetermined value and the detected slip ratio is equal to or less than a predetermined slip ratio after the gear position is changed to the first speed by the first-speed changer.

6. The apparatus according to claim 1, further including:

a trim angle regulating mechanism adapted to regulate a trim angle of the outboard motor relative to the boat through trim-up/down operation; and a trim-up starter adapted to start the trim-up operation by operating the trim angle regulating mechanism when the detected engine speed is equal to or greater than a second predetermined speed and the detected navigation acceleration is equal to or less than a second predetermined value after the gear position is changed to the first speed by the first-speed changer.

7. The apparatus according to claim 6, further including:

a navigation acceleration decreasing change determiner adapted to determine whether the navigation acceleration detected during navigation is changed in a decreasing direction, and the trim-up starter starts the trim-up operation by operating the trim angle regulating mechanism when the detected engine speed is equal to or greater than the second predetermined speed, the detected navigation acceleration is equal to or less than the second predetermined value and the navigation acceleration is determined to be changed in the decreasing direction after the gear position is changed to the first speed by the first-speed changer.

8. The apparatus according to claim 6, further including:

a trim-up stopper adapted to stop the trim-up operation when the trim angle reaches a predetermined angle after the trim-up operation is started by the trim-up starter.

9. The apparatus according to claim 7, further including:

a trim-up stopper adapted to stop the trim-up operation when the trim angle reaches a predetermined angle after the trim-up operation is started by the trim-up starter.

10. An apparatus for controlling operation of an outboard motor mounted on a stern of a boat and having an internal combustion engine to power a propeller through a power transmission shaft; and a transmission that is installed at the power transmission shaft, is changeable in gear position to establish speeds including at least a first speed and a second speed, and transmits an output of the engine to the propeller with a gear ratio determined by established one of the speeds, comprising:

acceleration instruction determining means for determining whether acceleration is instructed to the engine by an operator when the second speed is established;

engine speed detecting means for detecting an engine speed of the engine;

navigation acceleration detecting means for detecting a navigation acceleration indicative of a change amount of navigation speed of the boat per predetermined time;

first-speed changing means for changing the gear position from the second speed to the first speed by operating the transmission when the acceleration is determined to be instructed; and second-speed changing means for changing the gear position from the first speed to the second speed when the detected engine speed is equal to or greater than a first predetermined speed and the detected navigation acceleration is equal to or less than a first predetermined value after the gear position is changed to the first speed by the first-speed changing means.

11. The apparatus according to claim 10, further including:

receiving means for receiving a GPS signal, and the navigation acceleration detecting means detects the navigation acceleration based on an output of the receiving means.

12. The apparatus according to claim 11, wherein the navigation acceleration detecting means detects the navigation acceleration by detecting the navigation speed based on the output of the receiving means and differentiating the detected navigation speed.

13. The apparatus according to claim 1, further including:

throttle opening change amount detecting means for detecting a change amount of throttle opening of the engine, and the acceleration instruction determining means determines that the acceleration is instructed when the detected throttle opening change amount is equal to or greater than a prescribed value.

14. The apparatus according to claim 10, further including:

slip ratio detecting means for detecting a slip ratio of the propeller based on theoretical velocity of the boat and the navigation speed, and the second-speed changing means changes the gear position from the first speed to the second speed when the detected engine speed is equal to or greater than the first predetermined speed, the detected navigation acceleration is equal to or less than the first predetermined value and the detected slip ratio is equal to or less than a predetermined slip ratio after the gear position is changed to the first speed by the first-speed changing means.

15. The apparatus according to claim 10, further including:

trim angle regulating means for regulating a trim angle of the outboard motor relative to the boat through trim-up/down operation; and trim-up starting means for starting the trim-up operation by operating the trim angle regulating means when the detected engine speed is equal to or greater than a second predetermined speed and the detected navigation acceleration is equal to or less than a second predetermined value after the gear position is changed to the first speed by the first-speed changing means.

16. The apparatus according to claim 15, further including:

navigation acceleration decreasing change determining means for determining whether the navigation acceleration detected during navigation is changed in a decreasing direction, and the trim-up starting means starts the trim-up operation by operating the trim angle regulating means when the detected engine speed is equal to or greater than the second predetermined speed, the detected navigation acceleration is equal to or less than the second predetermined value and the navigation acceleration is determined to be changed in the decreasing direction after the gear position is changed to the first speed by the first-speed changing means.

17. The apparatus according to claim 15, further including:

trim-up stopping means for stopping the trim-up operation when the trim angle reaches a predetermined angle after the trim-up operation is started by the trim-up starting means.

18. The apparatus according to claim 16, further including:

trim-up stopping means for stopping the trim-up operation when the trim angle reaches a predetermined angle after the trim-up operation is started by the trim-up starting means.

19. A method for controlling operation of an outboard motor mounted on a stern of a boat and having an internal combustion engine to power a propeller through a power transmission shaft; and a transmission that is installed at the power transmission shaft, is changeable in gear position to establish speeds including at least a first speed and a second speed, and transmits an output of the engine to the propeller with a gear ratio determined by established one of the speeds, comprising the steps of:

determining whether acceleration is instructed to the engine by an operator when the second speed is established;

detecting an engine speed of the engine;

detecting a navigation acceleration indicative of a change amount of navigation speed of the boat per predetermined time;

changing the gear position from the second speed to the first speed by operating the transmission when the acceleration is determined to be instructed; and changing the gear position from the first speed to the second speed when the detected engine speed is equal to or greater than a first predetermined speed and the detected navigation acceleration is equal to or less than a first predetermined value after the gear position is changed to the first speed.

20. The method according to claim 19, wherein the step of navigation acceleration detecting detects the navigation acceleration based on an output of a receiver adapted to receive a GPS signal.

21. The method according to claim 20, wherein the step of navigation acceleration detecting detects the navigation acceleration by detecting the navigation speed based on the output of the receiver and differentiating the detected navigation speed.

22. The method according to claim 19, further including the step of:

detecting a change amount of throttle opening of the engine, and the step of acceleration instruction determining determines that the acceleration is instructed when the detected throttle opening change amount is equal to or greater than a prescribed value.

23. The method according to claim 19, further including the step of:

detecting a slip ratio of the propeller based on theoretical velocity of the boat and the navigation speed, and the step of second-speed changing changes the gear position from the first speed to the second speed when the detected engine speed is equal to or greater than the first predetermined speed, the detected navigation acceleration is equal to or less than the first predetermined value and the detected slip ratio is equal to or less than a predetermined slip ratio after the gear position is changed to the first speed.

24. The method according to claim 19, further including the step of:

starting the trim-up operation by operating a trim angle regulating mechanism adapted to regulate a trim angle of the outboard motor relative to the boat through trim-up/down operation, when the detected engine speed is equal to or greater than a second predetermined speed and the detected navigation acceleration is equal to or less than a second predetermined value after the gear position is changed to the first speed.

25. The method according to claim 24, further including the step of:

determining whether the navigation acceleration detected during navigation is changed in a decreasing direction, and the step of starting starts the trim-up operation by operating the trim angle regulating mechanism when the detected engine speed is equal to or greater than the second predetermined speed, the detected navigation acceleration is equal to or less than the second predetermined value and the navigation acceleration is determined to be changed in the decreasing direction after the gear position is changed to the first speed.

26. The method according to claim 24, further including the step of:

stopping the trim-up operation when the trim angle reaches a predetermined angle after the trim-up operation is started.

27. The method according to claim 25, further including the step of:

stopping the trim-up operation when the trim angle reaches a predetermined angle after the trim-up operation is started.

* * * * *